US009174220B2

(12) United States Patent
Lucas et al.

(10) Patent No.: US 9,174,220 B2
(45) **Date of Patent: *Nov. 3, 2015**

(54) DRYER/GRINDER

(71) Applicant: Scott Equipment Company, New Prague, MN (US)

(72) Inventors: Richard R. Lucas, Jordan, MN (US); Christopher T. Dolan, New Prague, MN (US); Gilbert F. Sticha, New Prague, MN (US)

(73) Assignee: Scott Equipment Company, New Prague, MN (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/264,496

(22) Filed: Apr. 29, 2014

(65) Prior Publication Data

US 2014/0231560 A1 Aug. 21, 2014

Related U.S. Application Data

(63) Continuation of application No. 12/760,714, filed on Apr. 15, 2010, now Pat. No. 8,714,467.

(60) Provisional application No. 61/299,788, filed on Jan. 29, 2010.

(51) Int. Cl.
*B02C 13/00* (2006.01)
*B02C 21/00* (2006.01)
(Continued)

(52) U.S. Cl.
CPC ..... *B02C 21/00* (2013.01); *B02C 13/00* (2013.01); *B02C 13/13* (2013.01); *F26B 25/08* (2013.01)

(58) Field of Classification Search
CPC ..... B02C 13/00; B02C 13/02; B02C 13/10; B02C 13/28; B02C 13/2804; B02C 13/286; B02C 13/284; B02C 13/13; B02C 2013/1892; B02C 2013/26; F26B 25/06; F26B 25/08
USPC ..... 241/65, 188.1, 189.1, 195, 101.2, 88.4
See application file for complete search history.

(56) References Cited

U.S. PATENT DOCUMENTS

| | | | |
|---|---|---|---|
| 850,988 | A | 4/1907 | Williams |
| 879,219 | A | 2/1908 | Towns |
| 950,607 | A | 3/1910 | Baldwin |

(Continued)

FOREIGN PATENT DOCUMENTS

| | | |
|---|---|---|
| DE | 3317572 | 11/1983 |
| DE | 3333898 | 4/1985 |

(Continued)

OTHER PUBLICATIONS

Scott Equipment's marketing brochure entitled "Scott A.S.T. Dryer" Oct. 1995.

(Continued)

*Primary Examiner* — Faye Francis
(74) *Attorney, Agent, or Firm* — Vidas, Arrett & Steinkraus

(57) ABSTRACT

A grinder/dryer having a plurality of beater blades carried on a rotating shaft in a cylindrical housing, including one or a plurality of grinding members on the cylindrical side wall. The grinding members are adjustably positioned at different locations within the cylinder. The grinding members may be provided in a variety of different combination of elevated ridges and/or valleys used to dry and classify materials.

20 Claims, 18 Drawing Sheets

(51) Int. Cl.
*B02C 13/13* (2006.01)
*F26B 25/08* (2006.01)

(56) References Cited

U.S. PATENT DOCUMENTS

| | | | |
|---|---|---|---|
| 1,625,554 | A | 4/1927 | Liggett |
| 1,751,009 | A | 3/1930 | Liggett |
| 2,040,700 | A | 5/1936 | Magaton |
| 2,460,008 | A | 1/1949 | Heller |
| 2,770,543 | A | 11/1956 | Arnold et al. |
| 2,857,612 | A | 10/1958 | Fischer |
| 3,246,594 | A | 4/1966 | Fisher |
| 3,252,406 | A | 5/1966 | Altman |
| 3,574,632 | A | 4/1971 | Lanz |
| 3,629,994 | A | 12/1971 | Jones |
| 3,677,478 | A | 7/1972 | Schutte |
| 3,771,294 | A | 11/1973 | Ronning |
| 3,772,847 | A | 11/1973 | Houtman et al. |
| 3,862,594 | A | 1/1975 | Stolting et al. |
| 3,973,735 | A | 8/1976 | Ito et al. |
| 4,001,452 | A | 1/1977 | Williams |
| 4,076,177 | A | 2/1978 | Hirayama et al. |
| 4,111,632 | A | 9/1978 | Leaver |
| 4,129,260 | A | 12/1978 | Baker |
| 4,131,247 | A | 12/1978 | Danberg |
| 4,149,859 | A | 4/1979 | Vigesdal |
| 4,213,571 | A | 7/1980 | Deardorff et al. |
| 4,226,375 | A | 10/1980 | Cameron |
| 4,285,271 | A | 8/1981 | Falck et al. |
| 4,308,037 | A | 12/1981 | Meissner et al. |
| 4,312,265 | A | 1/1982 | Enterline et al. |
| 4,325,516 | A | 4/1982 | Ismar |
| 4,479,613 | A | 10/1984 | Rowledge |
| 4,665,810 | A | 5/1987 | Falck |
| 4,702,426 | A | 10/1987 | Citterio |
| 4,767,066 | A | 8/1988 | Williams |
| 4,767,301 | A | 8/1988 | Volk, Jr. |
| 4,830,291 | A | 5/1989 | Williams |
| 4,863,652 | A | 9/1989 | Chang |
| 4,874,402 | A | 10/1989 | Vogel |
| 4,935,874 | A | 6/1990 | Volk, Jr. |
| 4,940,334 | A | 7/1990 | Musil |
| 4,966,733 | A | 10/1990 | Fernando et al. |
| 5,062,575 | A | 11/1991 | Barnabie et al. |
| 5,136,791 | A | 8/1992 | Fraile et al. |
| 5,199,653 | A | 4/1993 | Durrant et al. |
| 5,271,163 | A | 12/1993 | Pikus et al. |
| 5,378,265 | A | 1/1995 | Pearl |
| 5,526,988 | A | 6/1996 | Rine |
| 5,558,281 | A | 9/1996 | Bouldin et al. |
| 5,570,517 | A | 11/1996 | Luker |
| 5,585,124 | A | 12/1996 | Bittner |
| 5,641,338 | A | 6/1997 | Brookman |
| 5,681,371 | A | 10/1997 | Carr |
| 5,887,808 | A | 3/1999 | Lucas |
| 5,902,250 | A | 5/1999 | Verrier et al. |
| 6,248,156 | B1 | 6/2001 | Lucas |
| 6,713,112 | B1 | 3/2004 | Lucas |

FOREIGN PATENT DOCUMENTS

| | | |
|---|---|---|
| GB | 2297823 | 8/1996 |
| GB | 2324141 | 10/1998 |
| WO | 95/23625 | 9/1995 |

OTHER PUBLICATIONS

Scott Equipment's marketing brochure entitled "Scott's New Turbo Dominator" Apr. 1996.

(Prior Art)

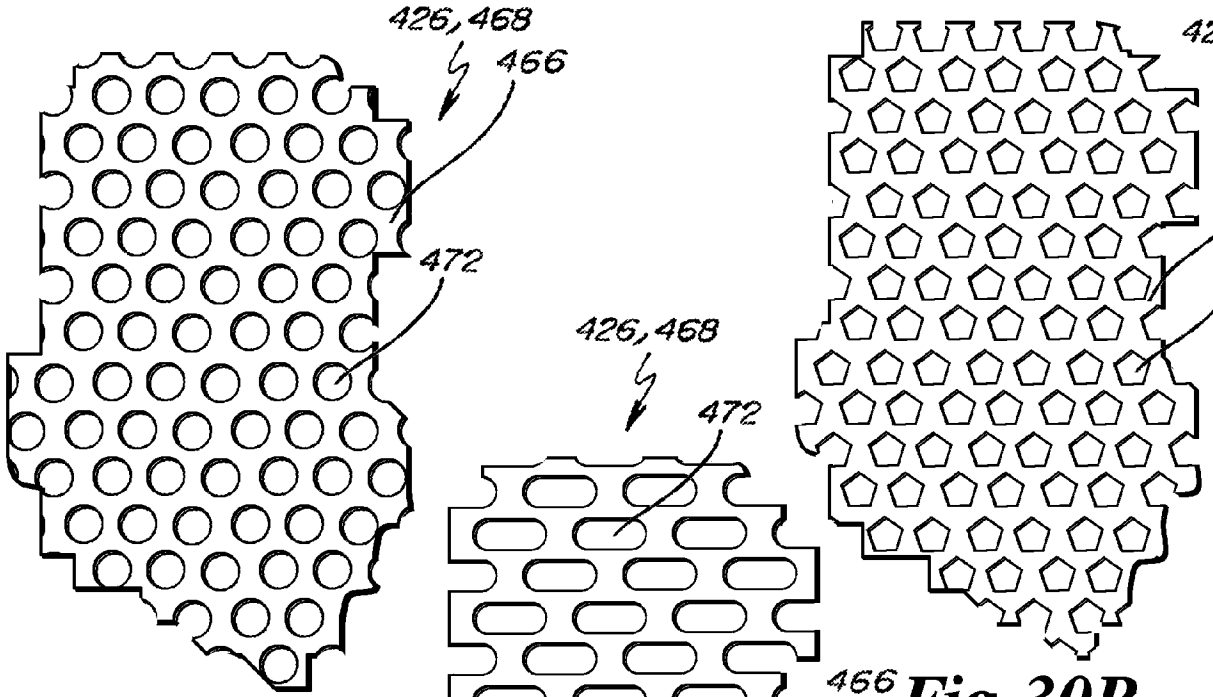
Fig.30A
Fig.30B
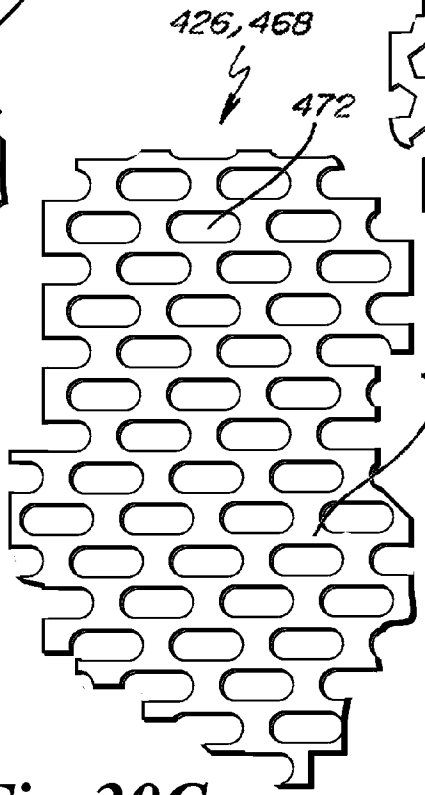
Fig.30C
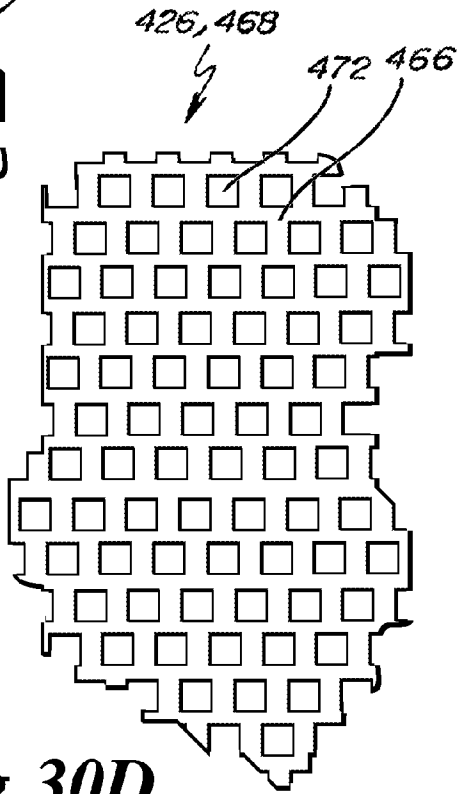
Fig.30D

DRYER/GRINDER

CROSS-REFERENCE TO RELATED APPLICATIONS

This application is a continuation application of U.S. patent application Ser. No. 12/760,714, filed Apr. 15, 2010, now U.S. Pat. No. 8,714,467 which claims the benefit of U.S. Provisional Patent Application Ser. No. 61/299,788, which was filed Jan. 29, 2010, all of which is incorporated herein by reference in its entireties.

BACKGROUND OF THE INVENTION

This invention relates to the field of heavy duty continuous flow material processing equipment, more particularly continuous co-flow combination dryers/grinders for reducing the moisture content of wet, slurry and/or similar materials such as clay. As used herein the materials may include a relatively high liquid-to-solid ratio. Most often the liquid is water. The processing equipment additionally grinds and refines the materials to be processed, separating impurities from materials into usable components.

It is to be understood that the term "co-flow" refers to a design in which the air and material flow in the same direction in the dryer, in contrast to "counter-flow" designs, for example.

In the past, co-flow dryers were capable of drying slurries up to only about 60% moisture in a single pass without adding dry powder to the material to be dried.

Known dryers may include rotary drum dryers and fluidized bed dryers which are typical of other continuous drying processes in which very little mixing action occurs. Air swept tubular dryers have been observed to be more efficient than the rotary drum or fluidized bed type processes. In at least one embodiment, the dryer/grinder 402 is capable of removing 750 pounds of water for every 1000 CFM of air used in the process, at production rates of up to 50 tons per hour of material processed, with a retention time in the dryer in the range of approximately ¼ to 1 minute.

Applicant in the past has contemplated the use of Applicant's dryer as disclosed in U.S. Pat. No. 5,570,517 in the processing/drying of clay and other materials. Applicant recently attempted to process and to dry clay and other materials with applicant's dryer, whereupon applicant discovered that operational modifications were required to successfully accomplish the desired results. Applicant's invention herein is directed to the operational modifications/improvements. Applicant incorporates by reference herein, in their entireties, applicant's co-owned U.S. Pat. Nos. 5,570,517; 5,887,808; 6,248,156; and 6,713,112.

Applicant claims priority to U.S. Provisional Patent Application Ser. No. 61/299,788, filed Jan. 29, 2010, the entire contents of which are incorporated by reference herein in its entirety.

Grinding and comminuting apparatus are used for reducing the size of materials such as food products, chemicals, rubbers, resins, garbage (food waste), waste-paper, wood chips, waste fiber (cloth, gypsum), plastics, glass, metal chips or the like. Conventional grinding/comminuting apparatus such as that disclosed in U.S. Pat. No. 4,129,260, issued Dec. 12, 1978 to Baker, entitled Garbage Disposal, and U.S. Pat. No. 3,973,735, issued Aug. 10, 1976 to Ito et al., entitled Apparatus For Pulverizing And Sorting Municipal Waste, typically include a grinding chamber with high speed rotating beaters/hammers that tear, shred, slash, cut and grind one or more desired products to a desired size as the products) are forced between the rotating beaters/hammers, and a set of breaker bars, and to a very limited extent, also between the rotating beaters/hammers, and one or more screening elements.

The dryer/grinder invention also relates to a process and apparatus that facilitates efficient recovery of particulate and/or dust which becomes airborne as a result of a product being exposed to industrial refining and drying processes. Devices have been used in conjunction in an attempt to remove particulate content from the air stream in a controlled manner Devices such as a conventional centrifuge or cyclone, bag houses and other types of separators have been employed using a number of configurations and methods. A separator may be beneficial, which has the capability to efficiently and effectively capture particulate and/or dust that is picked up in the air stream of current dryer/grinding apparatus.

Materials to be processed may have a particle size of less than approximately one-sixteenth inch and rarely having a size in excess of approximately an inch. Materials may be naturally forming or be waste residue. Materials to be processed may have a large range of moisture content and particle size.

The present invention is directed to a dry process which minimizes the environmental impact associated with the water separation techniques used when processing materials. The present invention captures sand, crushed gravel, silica, sulfur, attapugite clay, bentonite clay, kaolin clay, and calcium and other materials for use in other industries such as the cement and concrete industries. The present invention avoids the initial placement of waste materials in the form of a slurry into the environment, as well as being used to reclaim previous coal slurry impounds. The present invention in addition avoids the use of chemicals during the reclaiming or residual material recovery processes.

In the past materials to be processed may have an undesirable moisture content, requiring the material to be dried by exposing the wet material to heat. The drying of the materials to be processed in this manner may be energy inefficient and costly. The present invention reduces the moisture content of the materials to be processed to a desired level by the introduction of a combination of heat and blown air during the refining process, as opposed to exposure to heat alone. The present invention improves the efficiency of the drying of the materials at a lower and more economical energy consumption level, in order to maximize energy and economic savings. The present invention is ecologically friendly by recovering and converting previously discarded waste into useful value-added products while simultaneously cleansing previously polluted environments.

BRIEF DESCRIPTION OF THE DRAWINGS

FIG. 30A is an alternative partial cut away detail view of a grinder member of one embodiment of the present invention.

FIG. 30B is an alternative partial cut away detail view of an alternative grinding member of one embodiment of the present invention.

FIG. 30C is an alternative partial cut away detail view of an alternative grinding member of one embodiment of the present invention.

FIG. 30D is an alternative partial cut away detail view of an alternative grinding member of one embodiment of the present invention.

DETAILED DESCRIPTION OF THE INVENTION

Figure 1:
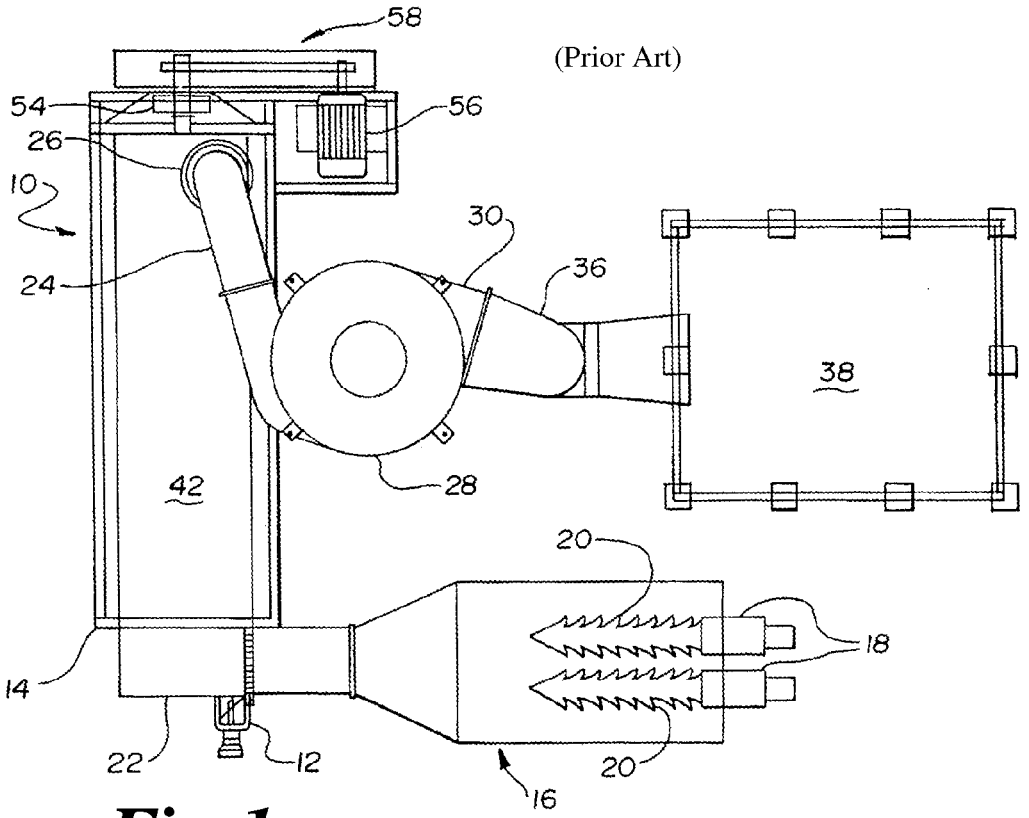
(Prior Art) Fig.1
FIG. 1 is a plan view of a slurry dryer.
Figure 2:
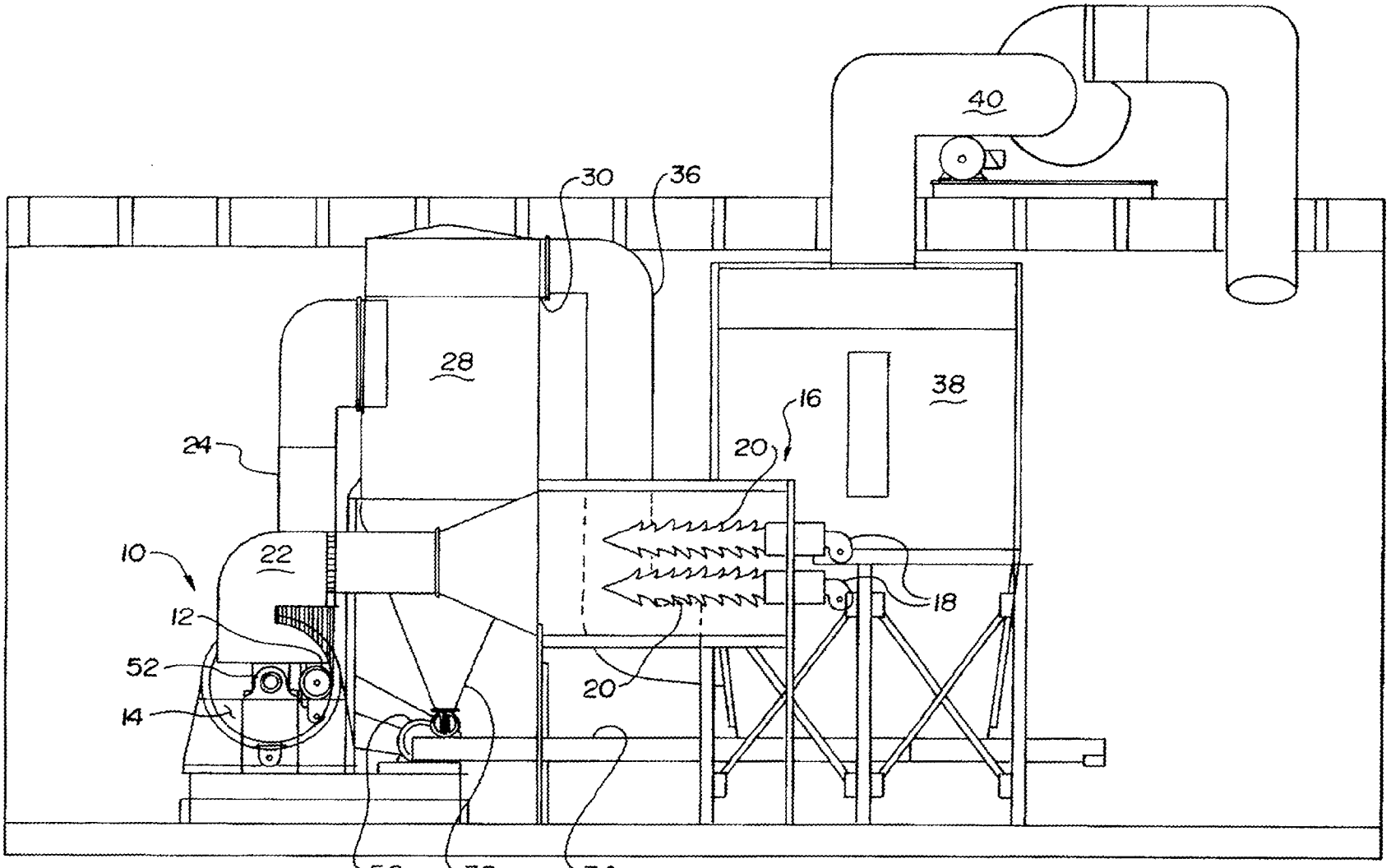
(Prior Art) Fig. 2
FIG. 2 is an end elevation view of the dryer of FIG. 1.
Figure 15:
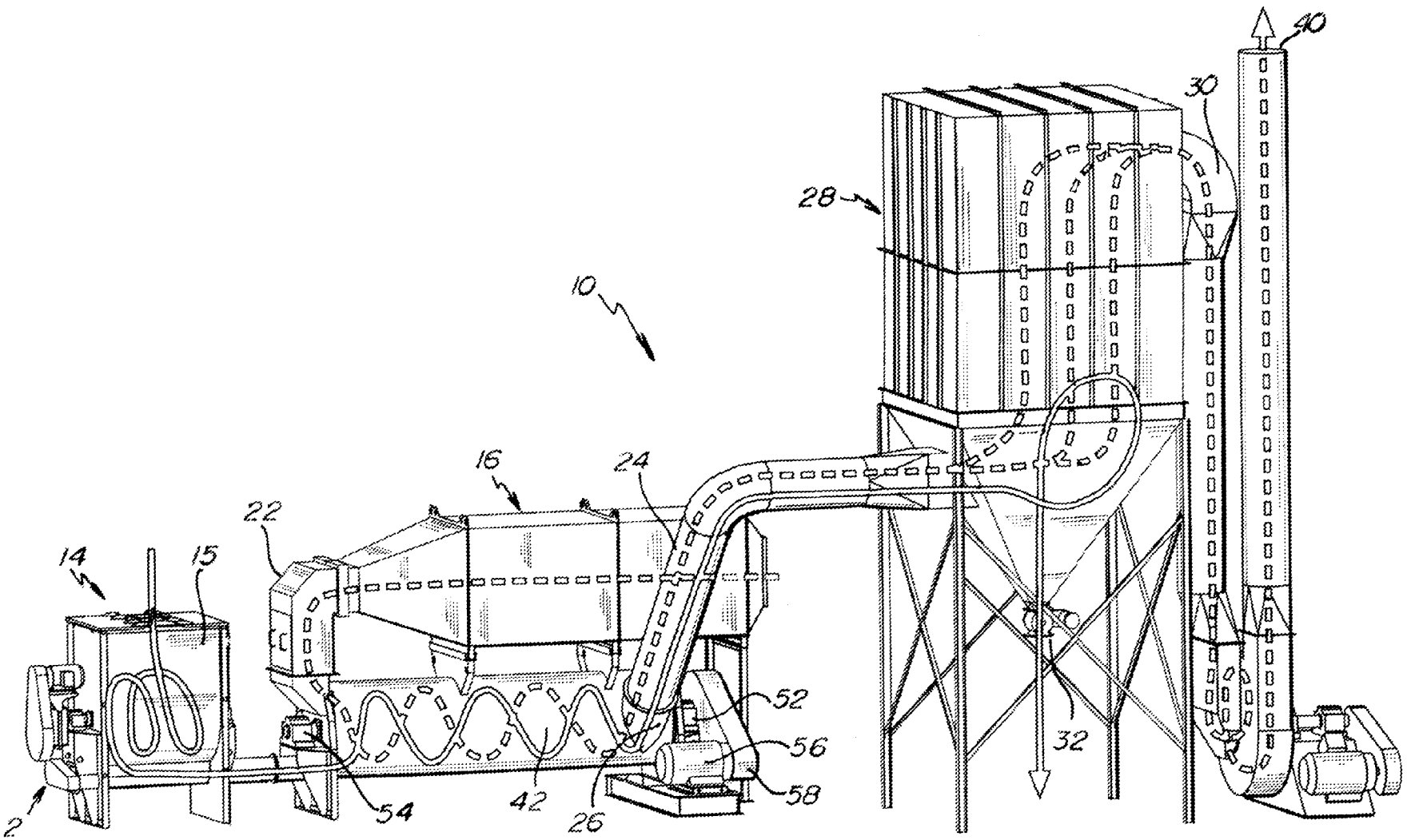
FIG. 15 is a perspective view of one embodiment of a drying system.

Referring now to the Figures, and most particularly to FIGS. 1, 2 and 15 a slurry dryer 10 may be seen, along with associated equipment useful in the practice of the present invention. The associated equipment in at least one embodiment may include a slurry feed pump 12 connected to an inlet end 14 of dryer 10 a source of hot air 16 which may include one or more blowers 18 and burners 20. Inlet end 14 may include an inlet hopper 15. The hot air is connected by an inlet air duct 22 to the inlet end 14 of dryer 10. An outlet duct 24 may be connected between an outlet 26 of dryer 10 and a conventional cyclone separator 28. Separator 28 may have an air outlet 30 and a material outlet 32. In at least one embodiment a material outlet 32 may be connected to a material delivery conveyor 34. Air outlet 30 may be connected by a duct 36 to a dust collector 38. Once the air is filtered by dust collector 38, it may be exhausted to atmosphere via duct 40.

Figure 3:
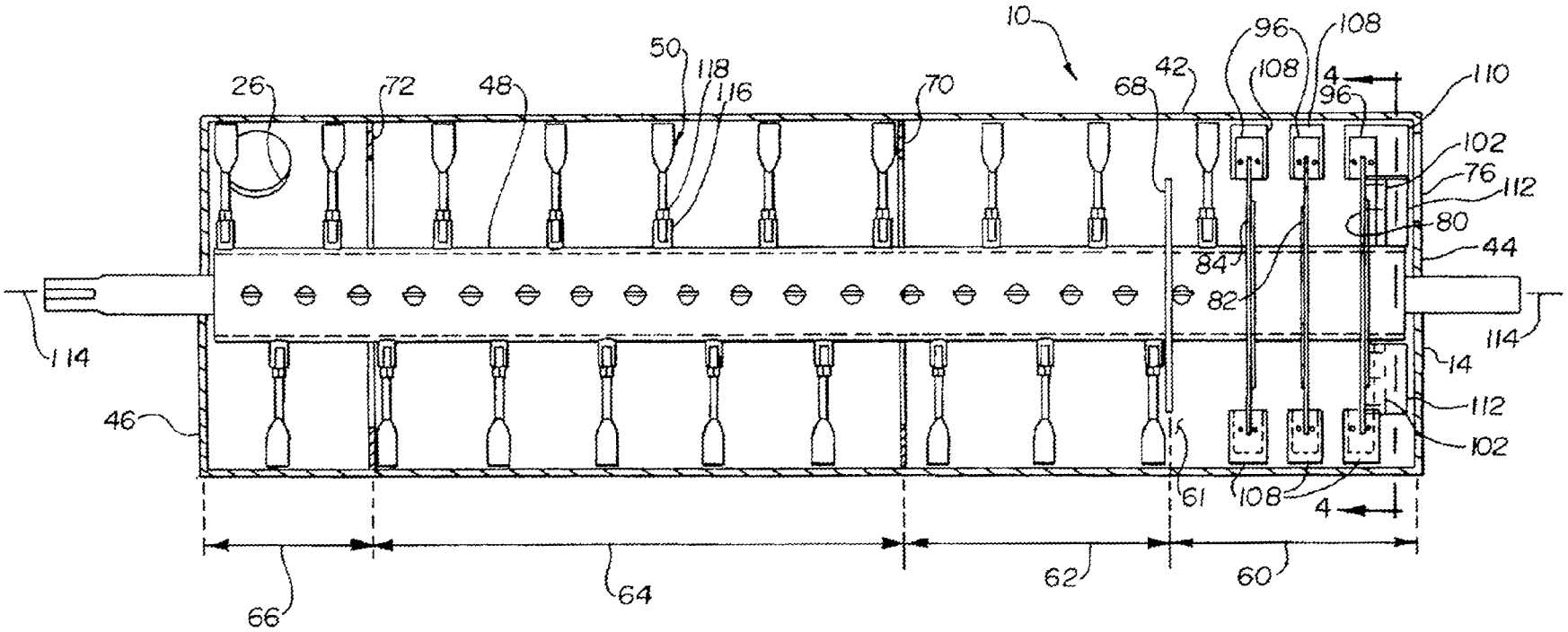
(Prior Art) Fig. 3
FIG. 3 is a side elevation view, partly section view, of the interior of the slurry dryer.

Referring now also to FIG. 3, dryer 10 in at least one embodiment includes a cylindrical housing forming a side wall 42, an inlet end wall 44, an outlet end wall 46, and a shaft 48. Shaft 48 may carry a plurality of beater blades 50, each of which may be forged to have a relatively flat portion (of about 1½ to 2½ inches wide, depending upon the size of the dryer) extending from a cylindrical base portion of about ⅞ to 1⅛ inches diameter of a respective beater blade 50. In some embodiments the size dimensions for the relatively flat portions of the beater blades 50 may be larger or smaller than the dimensions identified herein. In addition, in some embodiments the size dimensions indicated for the cylindrical base portion of the beater blades 50 may be larger or smaller than the dimensions indicated herein.

Shaft 48 may be supported for rotation by a pair of pillow blocks 52, 54 (see FIGS. 1 and 2); and in at least one embodiment shaft 48 is driven by an electric motor 56 via a conventional pulley and drive belt arrangement 58.

Referring now again to FIG. 3, in at least one embodiment the dryer 10 may have an inlet portion 60, a free-flow generating section 62, a retention zone 64, and a discharge zone 66. The inlet portion 60 may extend from inlet end wall 44 to a shaft mounted air dam 68. The free flow generating section 62 may extend from shaft mounted air dam 68 to housing mounted material dam 70. The retention zone 64 may extend between the housing mounted material dam 70 and a similar material dam 72. The discharge zone 66 may extend from dam 72 to outlet end wall 46.

In at least one embodiment, a cylindrical housing may have a diameter dimension of 30 inches and length dimension of 120 inches, the shaft mounted air dam 68 may be located approximately 26 inches from the inlet end wall 44; the first housing mounted dam 70 may be mounted approximately 53 inches from wall 44; and the second housing mounted dam 72 may be mounted approximately 103 inches from inlet end wall 44. In some embodiments the size dimensions for the cylindrical housing; the shaft mounted air dam 68 from the inlet end wall 44; the first housing mounted dam 70 from the inlet end wall 44; and the second housing mounted dam 72 from the inlet and wall 44 may be increased or decrease as compared to the size dimensions indicate immediately above. It is to be understood that with certain materials, and in certain embodiments, one or more additional housing mounted dams and/or shaft material air dams 68 may be used to control the flow of material in dryer 10. In at least one embodiment the beater blades 50, together with dams 70, 72 control the retention time of material in the housing, and it is to be understood that the length of the beater blades 50 defining a space between the relatively flat portions and the interior of the side wall 42, and the angle of pitch of the relatively flat portions of the beater blades 50, may be adjustable, and the respective components of the beater blades 50 may be replaceable. In at least one embodiment the beater blades 50 give intense mixing action in housing 42 to break up lumps and accomplish considerable size reduction as the slurry material is processed by dryer 10. Material exiting dryer 10 may have a moisture content of about 10% to about 1% or less, even though the material enters dryer 10 at a moisture content of up to about 90 percent. As may be seen in FIG. 3, dryer 10 may have three agitator disk or scraper blade assemblies 80, 82, 84. It is to be understood that, depending upon the material to be dried, one or more scraper blade assemblies identical to assembly 84 may be mounted on shaft 48, upstream or down stream of air dam 68 or material dams 70, 72.

Figure 4:
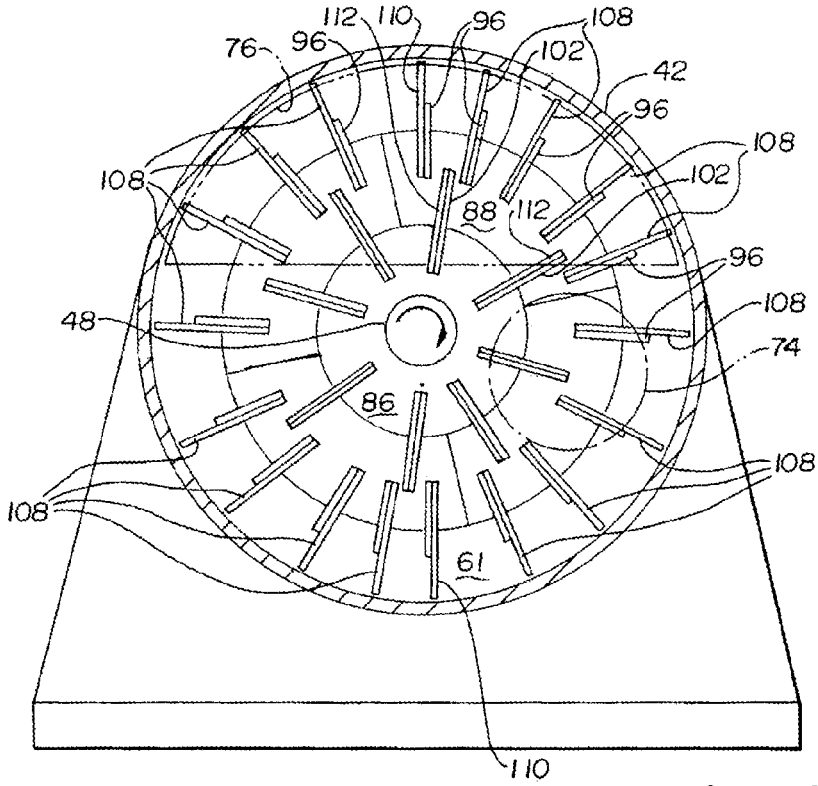
(Prior Art) Fig.4
FIG. 4 is a simplified end view of the interior of the slurry dryer taken along line 4-4 of FIG. 3 and showing an agitator disk assembly in plan view.
Figure 5:
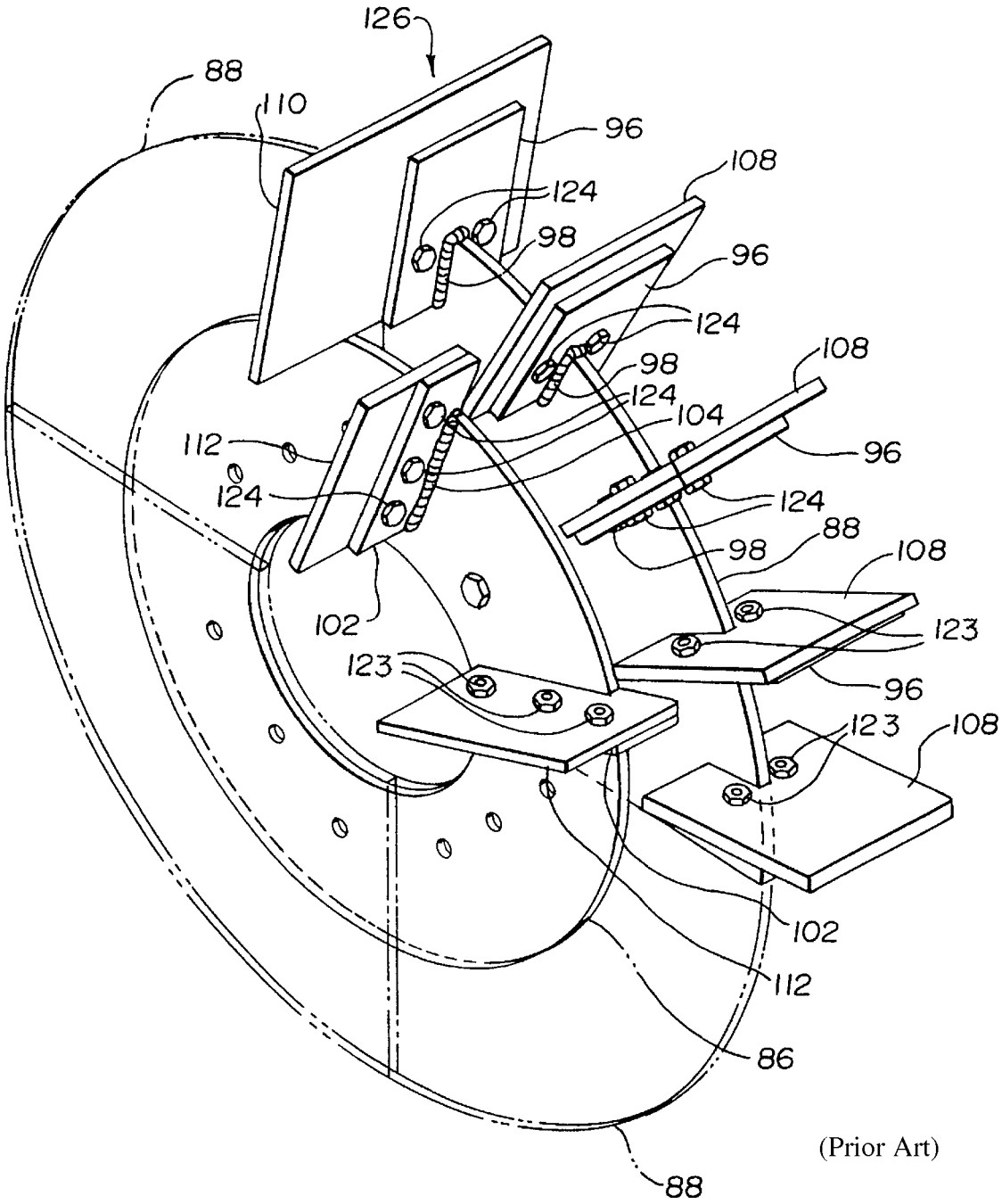
(Prior Art) Fig.5
FIG. 5 is a perspective view of the agitator disk assembly of FIG. 4.
Figure 6:
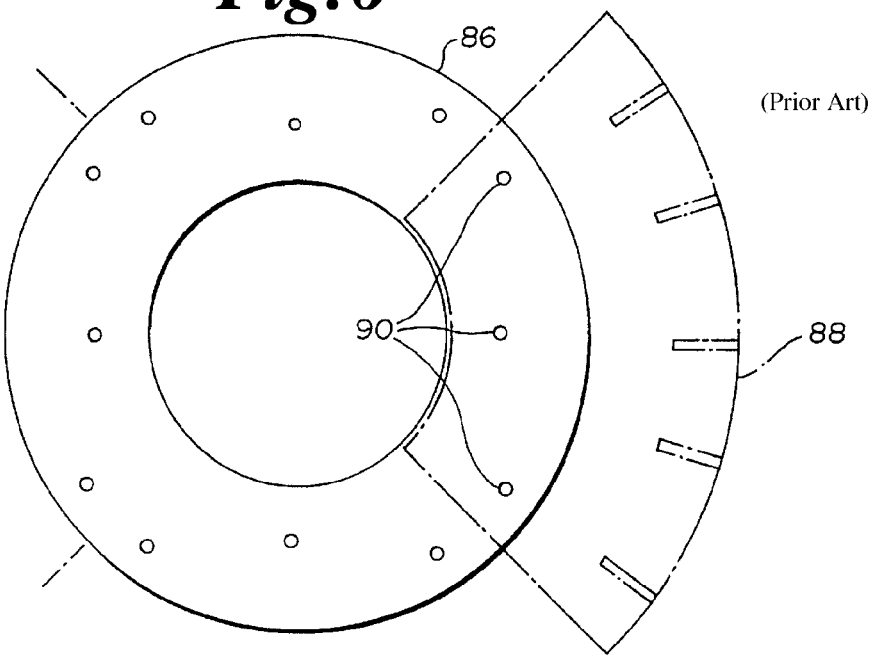
FIG. 6 is an enlarged plan view of a hub of the agitator disk assembly with a quadrant of the agitator disk shown in phantom.
Figure 7:
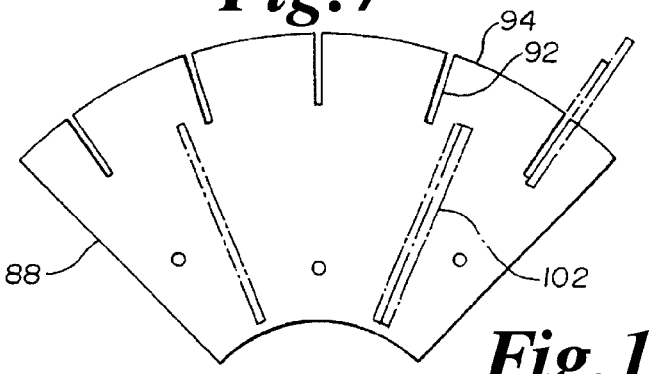
(Prior Art) Fig. 7 (Prior Art)
FIG. 7 is an enlarged plan view of a quadrant of the agitator disk with end and side wall scrapers and their supports shown in phantom.
Figure 8:
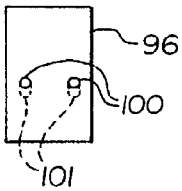
Fig. 8 (Prior Art)
FIG. 8 is a plan view of a cylindrical wall scraper blade support.
Figure 9:
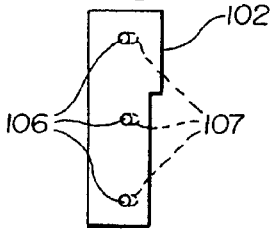
FIG. 9 is a plan view of an end wall scraper blade support.
Figure 10:
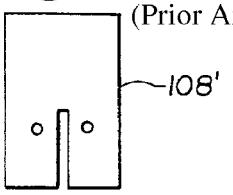
(Prior Art) Fig. 10 (Prior Art)
FIG. 10 is a plan view of a cylindrical wall scraper blade.
Figure 11:
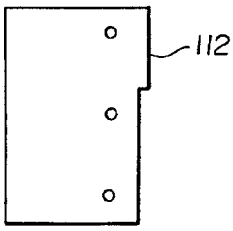
FIG. 11 is a plan view of an end wall scraper blade.
Figure 12:
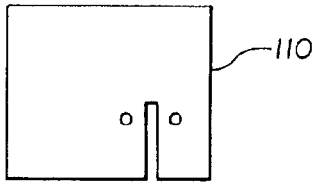
(Prior Art) Fig. 12
FIG. 12 is a plan view of a combined end and cylindrical wall scraper blade.

Referring to FIGS. 3 through 5, (but also to FIGS. 6-12 and 28) details of the agitator disk or scraper blade support assemblies 80, 82, 84 may be seen. Assemblies 82, 84 may be identical to each other and may be similar to assembly 80, which may differ in that it has additional and different scraper blades to remove material from inlet end wall 44 as well as from the cylindrical side wall 42. Each scraper blade assembly may have a central ring 86 supporting four identical quadrants 88. Ring 86 and quadrants 88 may be formed of ½ inch thick carbon steel and may have mating holes or apertures 90 for securing quadrants 88 to ring 86, as may best be seen in FIG. 6. Each quadrant 88 may include five radially oriented notches 92 at an outer circumferential periphery 94. Each notch 92 may be sized to receive a blade support 96, which may be welded (as at 98) to quadrant 88. Each blade support 96 (as shown in FIG. 8) may include a pair of holes or apertures 100 therein. The disk assembly 80 also preferably has four end wall scraper blade supports 102, two of which are shown in FIG. 5, and the position of which are shown in FIG. 7. Each end wall scraper blade support 102 may be secured to central ring 86 by a bead weld 104. As may be seen in FIG. 9 end wall scrapper blade supports 102 each may have a plurality of holes or apertures 106 therethrough. Blade supports 96 and 102 may be formed of ⅜ inch thick carbon steel. Support 96 may be 5 inches wide by 7½ inches long (in the radial direction); while support 102 may be about 12 inches long by about 2 inches wide, and may include a step along one side to mate with the step formed by the assembly of ring 86 and quadrant 88.

In at least one embodiment twenty cylindrical side wall scraper blades 108 are used on scraper blade assemblies 82 and 84, and eighteen cylindrical side wall scraper blades 108 are used on assembly 80. Assembly 80 may also have two combined end wall and cylindrical side wall scraper blades 110, in addition to eight end wall scraper blades 112. As may be seen in FIGS. 10, 11, and 12, each of blades 108, 110, and 112 may have mating apertures to mount the blades to their respective supports 96, 102, (for example, by conventional fasteners such as nuts 123 and bolts or machine screws 124) as may be seen most clearly in FIG. 5. Blades 108, 110, and 112 may be made of ¼ inch thick hardened steel or may be partially or entirely made of another hard material such as carbide for wear resistance. In at least one embodiment one of the sets of apertures in the scraper blades or the mounts may be elongated slots 101, 107 (shown by way of example at apertures 100, 106) to permit adjustment of the blades for dimension tolerance variations and for wear of the blades.

Figure 13:
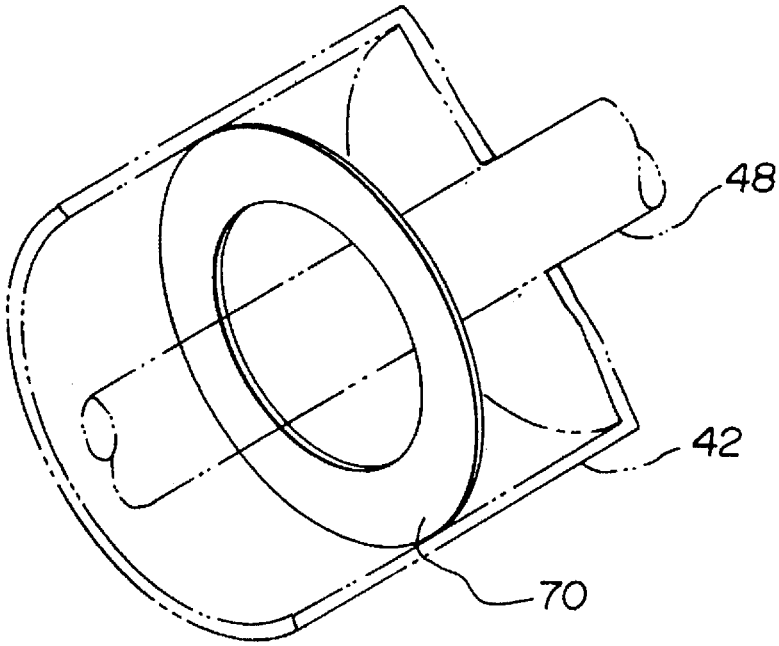
Fig.13 (Prior Art)
FIG. 13 is a perspective view of a side wall mounted dam with a portion of the cylindrical side wall and shaft shown in phantom.

Referring now also to FIG. 13, the housing mounted material dam 70 may be formed of a sheet metal toroid secured to cylinder by any conventional mechanism including but not limited to welding. In at least one embodiment dams 70 and 72 are each preferably ½ inch carbon steel with a radial dimension of 4 inches.

Figure 27:
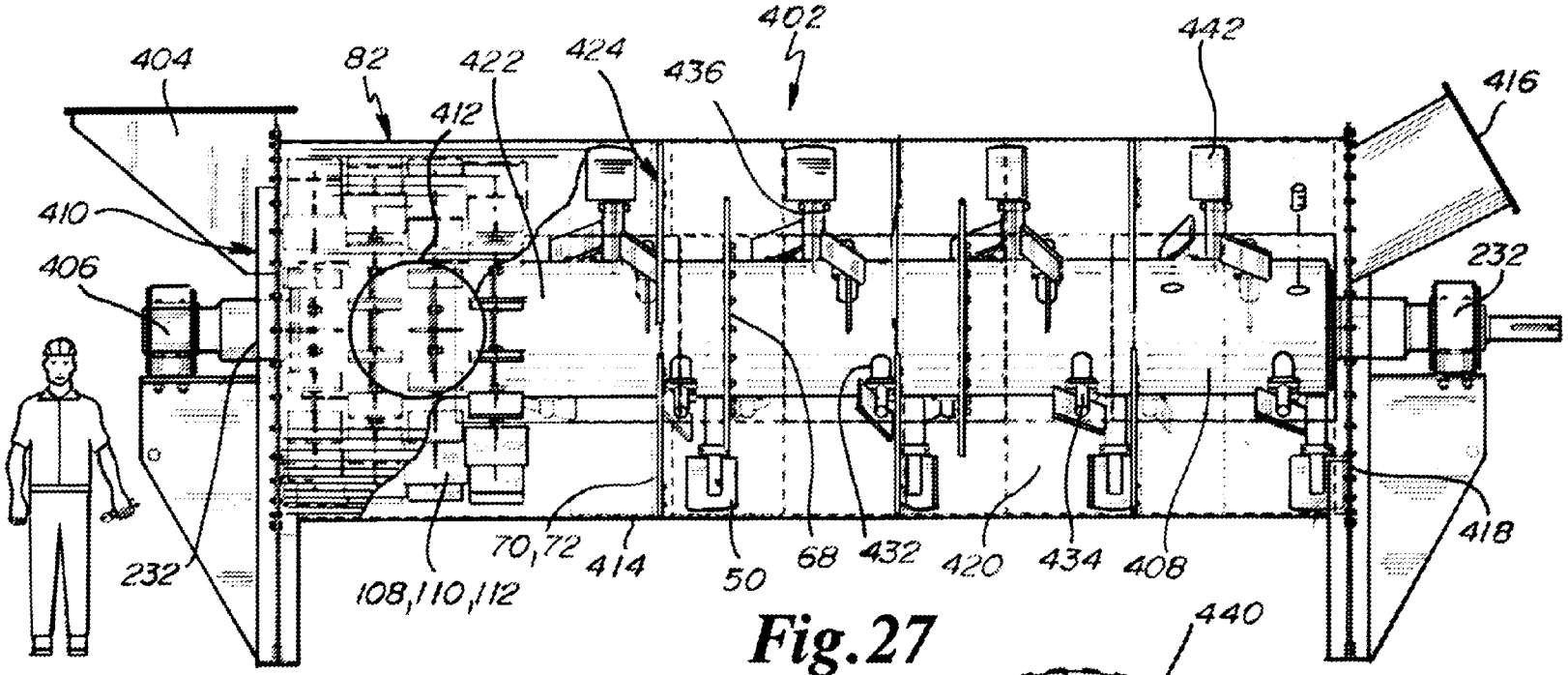
FIG. 27 is a partial cut away partial side view of one embodiment of the grinder/dryer.
Figure 35:
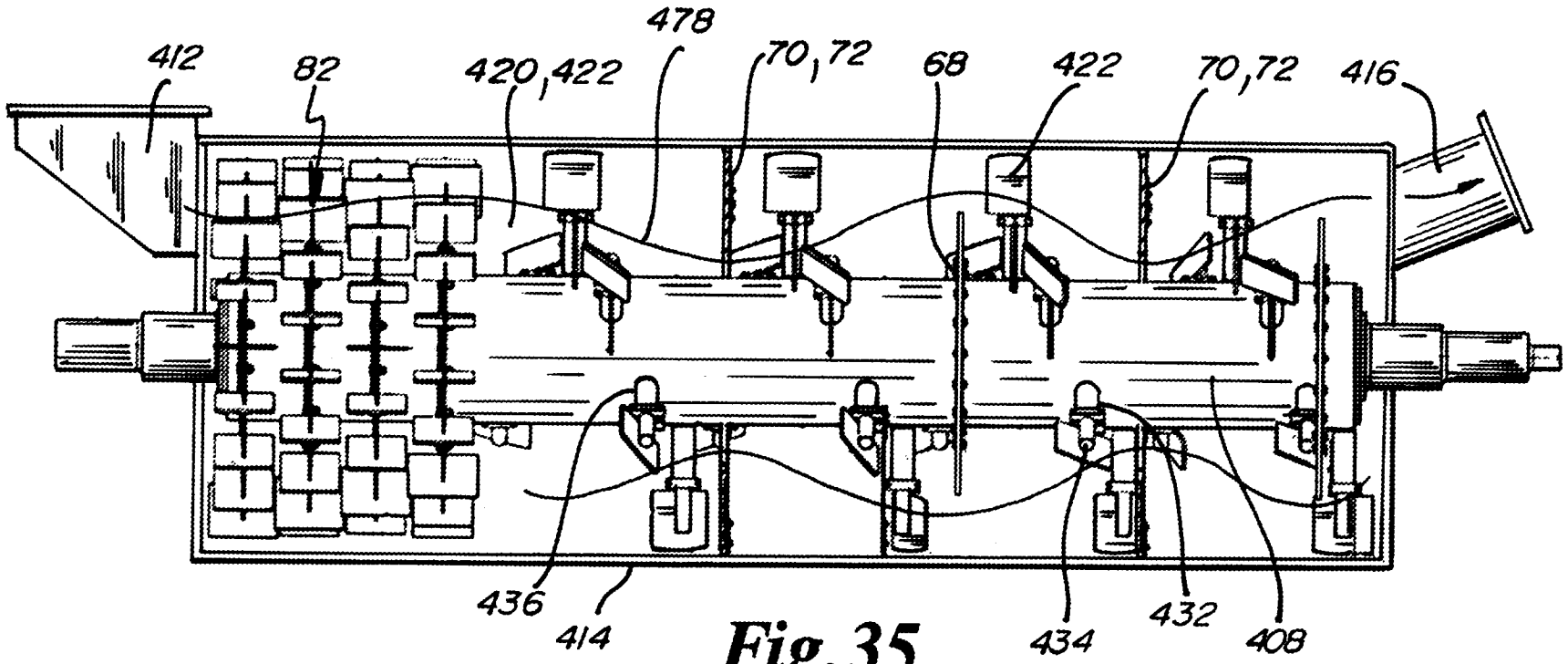
FIG. 35 is a cut away side view of one embodiment of the dryer/grinder showing the circulating passage of material over material dams and under air dams within the cylinder.

Referring now to FIGS. 3, 27 and 35, the shaft mounted air dam 68 (which may be fabricated of ⅜ inch thick carbon steel in sections such as quadrants and bolted together) may extend radially from the center of shaft 48 a distance of 23 inches to provide a 4 inch radial clearance between air dam 68 and cylindrical side wall 42.

Figure 14:
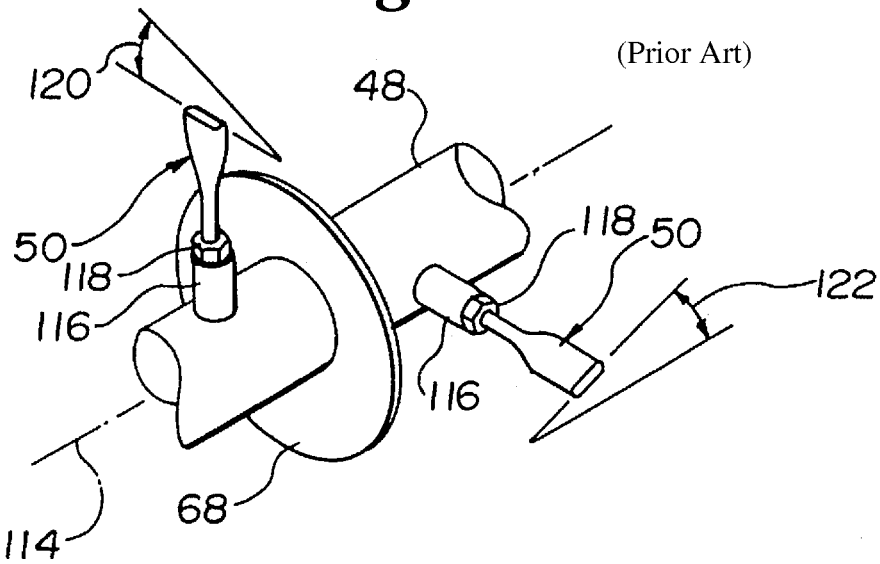
Fig.14 (Prior Art)
FIG. 14 is a perspective fragmentary view of a portion of the shaft assembly showing a shaft mounted air dam and a pair of beater blades.

In FIG. 3, all of the beater blades 50 are shown aligned with and extending perpendicularly from the axis 114 of shaft 48. In at least one embodiment each beater blade may be threaded and received in a threaded bore in sleeve 116, with sleeve 116 fixedly or adjustably attached to shaft 48. A nut 118 may be received on the threaded portion which may be provided on a beater blade 50, to position the beater blade 50 in a desired location or orientation with respect to either the plane of the shaft mounted air dam 68 (as indicated by angle 120) or with respect to the axis 114 of shaft 48 (as indicated by angle 122) (FIG. 14). In at least one embodiment the angles 120, 122 of the beater blades 50 are fully adjustable, with angles between zero and plus or minus 90 degrees resulting in orientation of the beater blades to advance (for plus angles) the slurry from inlet to outlet, or to retard (using minus angles) movement of the slurry through the dryer. By adjusting the plus/minus orientation of the beater blade angles in each of the portions or zones 60-66 of the dryer 10, the retention time of the slurry in that zone may be controlled. In at least one embodiment the beater blades 50 between the air dam 68 and the first material dam 70 form a first group of beater blades 50, while the beater blades 50 between the first and second material dams 70, 72 form a second group of beater blades 50. A third group of beater blades 50 is located between the second material dam 72 and the outlet end wall 46. In addition, as shown in FIG. 3, beater blades 50 may be located in the inlet portion 60, along with the scraper assemblies to aid in the mixing and drying process.

In at least one embodiment, the operation of the dryer is as follows. Air is heated by burners 20 to an appropriate temperature (for example 1200 degrees F. which may be used in association with high heat tolerable slurries, while 500 degrees F. may be desirable for lower heat tolerable slurries) and directed by blowers 18 through duct 22 to air inlet 76 in inlet end wall 44, where it enters the interior of cylindrical housing by forced convection. The slurry to be dried is urged into the inlet portion 60 of dryer 10 by feed pump 12 or anger connected to slurry or material inlet aperture 74 in inlet end wall 44. Motor 56 drives shaft 48 to rotate at a speed appropriate to both the material to be dried and the size of dryer 10, typically within the range of about 250 to 750 RPM. In at least one embodiment having a 30 inch diameter housing, a typical speed for shaft 48 may be 500 RPM.

An inlet scraper blade assembly 126 which may include scraper blades 108, 110, 112 is located on shaft 48. The scraper blades 108, 110, 112 may be mounted to provide about ¼ to ½ inch clearance to the end wall 44 and about ½ to 1 inch clearance to the cylindrical side wall 42, depending upon the slurry material, the moisture content, and the size of the dryer 10. The inlet scraper blade assembly 126 may also include central ring 86 and quadrants 88 which together may act as an inlet blade support structure.

Once the slurry enters the housing, the side and end wall scraper blades 108, 112 may prevent the slurry from building up on the interior of the side wall 42 and end wall 44 in the inlet region or portion 60 of dryer 10. Agitator disk assemblies 80, 82, and 84 stir or agitate the slurry in inlet portion 60 which in one embodiments is a "wet" zone within dryer 10.

The slurry may be exposed to the heated air in region 60, and in at least one embodiment a certain amount of "flash drying" or other drying occurs in zone 60. Incoming slurry may urge material already present in inlet zone 60 to move towards the "free-flow generating" zone 62.

Once in zone or section 62, the beater blades 50 may break up, of further break up, the material which may be in a lumpy, wet state in this region of the dryer 10. Once the drying solids of the slurry reach about 50% moisture (from a 90% initial moisture), the drying solids pass over material dam 70 and into the retention zone 64, typically aided by plus angle beater blades 50 located in the inlet and free-flow generating zones 60, 62.

Some or all of the beater blades 50 located in the retention zone 64 may be positioned to minus angles to retain the drying solids in that zone until the moisture content is typically 15 to 20 percent or a target moisture content.

As the solids dry, they may be carried by the air stream flowing through dryer 10 to, and out of, discharge zone 66 via outlet 26. In at least one embodiment one or more additional outlets may be provided at the side or bottom of cylindrical housing to aid in separating solids of varying densities.

In at least one embodiment, relatively dry (e.g. about 10% to about 1% or less moisture content) solids are transported as particles and/or dust via air exiting outlet 26 (which may now be at, for example, 200 degrees to 250 degrees F.) to cyclone separator 28. The particles and/or dust may typically be at a temperature of 125.degree. to 175 degree. F. as they exit housing.

The invention is not to be taken as limited to the features as identified above, as modifications and variations thereof may be made without departing from the spirit or scope of the invention.

In at least one embodiment, any number of housing mounted material dams 70 and/or material dams 72 may be disposed within the interior of the cylinder. In some embodiments, the housing mounted material dams 70 and/or material dams 72 may be regularly or irregularly spaced within the interior of the cylinder.

In at least one embodiment, housing mounted material dams 70 and/or material dams 72 may be formed of any desired metal, composite, or other rigid or rigidly flexible material, and may be of any increased or decreased size, radius, or diameter dimension. In some embodiments the size, radius, or diameter dimensions for the housing mounted material dams 70 and/or material dams 72 may be adjusted to enlarge or reduce the size of the passageway adjacent to the respective dam.

In at least one embodiment, the shaft mounted air dam 68 may be formed of metal, composite, and/or rigid material as desired. In at least one embodiment, the thickness dimension for the material selected for the shaft mounted air dam 68 may be increased and/or decreased in size. In some embodiments, the radius or diameter dimension for the shaft mounted air dam 68 may be increased or decreased to adjust the size of the passage way adjacent to the shaft mounted air dam 68. In some embodiments the shaft mounted air dam 68 is formed of one piece, or multiple pieces, which may be connected together. In at least one embodiment, in location of the shaft mounted air dam 68 may be movable along the shaft 48 for positioning, or repositioning, at any desired location along the longitudinal length of the shaft 48.

In some embodiments, a plurality and/or any number of free flow generating sections 62, inlet portions 60, retention zones 64, and/or discharge zones 66 may be provided within the interior of the cylinder for the dryer/grinder. In at least one embodiment, the free flow generating sections 62, inlet portions 60, retention zones 64, and/or discharge zones 66 are of approximately equal size dimensions. In at least one embodiment, the sections 62, portions 60, zones 64 and 66 are of unequal dimensions and/or size and may be arranged in any desired combination of larger and smaller zones within cylinder.

In at least one embodiment, any desired number of beater blades 50 may be disposed on each sleeve 116 and any number of sleeves 116 may be disposed along shaft 48. In at least one embodiment, any number of sleeves 116 may be disposed of at any desired location along shaft 48 having regular and/or irregular spacing between. In at least one embodiment, the shaft 48 is constructed and arranged so that the number of beater blades 50 and the location and spacing of beater blades 50 along the shaft 48 is freely adjustable to facilitate flexibility with respect to the processing of alternative types and compositions of material.

In at least one embodiment, the size dimensions for the individual beater blades 50 are identical. In at least one embodiment, the size dimensions selected for the individual beater blades 50 is not uniform and beater blades 50 having larger and smaller dimensions may be provided at any desired location along shaft 48. In at least one embodiment, any desired combination and/or configuration of beater blades 50 having larger and/or smaller dimensions may be disposed along shaft 48. In at least one embodiment, the separation between adjacent beater blades 50 may be adjusted regardless to the size dimension of an individual beater blades 50. In at least one embodiment, any desired combination of larger and smaller beater blades 50 may be grouped together along shaft 48.

In some embodiments, the separation distance between the distal end of the flat portions of the beater blades 50, and the strike members or grinding members 426 as adjacent to the interior side wall 42 of the cylindrical housing, may be adjusted to provide any desired spacing there between.

In at least one embodiment, the flat portions of each beater blade 50 may be adjusted to provide an angle of pitch as relative to the shaft 48. In at least one embodiment, the angle of pitch of the flat portions the beater blades 50 are identical. In at least one embodiment, the angle of pitch for the flat portions of the beater blades 50 may be unique or identical relative to another flat portion of an adjacent beater blade 50.

In some embodiments, the beater blades 50 having a desired configuration of angles of pitch for the flat portions, may be repeated along the shaft 48 to assist in the establishment of the sections 62, portions 60, zones 64 and/or discharge zones 66. In at least one embodiment, the angles of pitch for each of the flat portions of the beater blades 50 may be freely adjustable to facilitate flexibility with respect to the processing of alternative types or compositions of material within the dryer/grinder. The angles of pitch for the beater blades 50 may be freely adjusted to shorten or lengthen the duration of time material is within a particular portion, section, and/or zone, in order to accomplish drying of the material to a desired moisture content.

In at least one embodiment, any number of agitator disk 80 or scraper blade assemblies 82 may be used along the shaft 48 within the cylindrical housing of the grinder/dryer. In at least one embodiment, the use of the agitator disk 80 and/or scraper blade assemblies 82 is not limited or restricted to a portion or zone adjacent to the inlet end 14 of the cylindrical housing for the dryer/grinder, and may be used at any desired location along the shaft 48. In at least one embodiment, the agitator disk 80 and/or scraper blade assemblies 82 may be regularly or irregularly spaced along the shaft 48 or disposed at any desired location along the shaft 48 within the interior of the cylinder or the grinder/dryer.

In at least one embodiment, each quadrant 88 of central ring 86 may have a larger or smaller number of notches 92 and blade supports 96, 102. In some embodiments, each agitator disk 80 or scraper blade assemblies 82 may have a larger or smaller number of end scraper blades to facilitate flexibility in the processing of alternative types and compositions of material within the dryer/grinder.

In at least one embodiment, the thickness dimension for the blade supports 96, 102 may be increased or decreased and the materials selected for the blade supports 96, 102 may be readily substituted with another type or hardness of metal, composite, and/or other rigid material. In at least one embodiment, the dimensions for the blade supports 96 and the end wall scraper blade supports 102 may be increased or decreased to provide flexibility with respect to the processing of alternative types or compositions of material.

In at least one embodiment the number cylindrical side wall scraper blades 108 and/or combined end wall and cylindrical side wall scraper blades 110 on assemblies 80, 82, 84 may be increased or decreased. In at least one embodiment assembly 80 may also include a larger or smaller number of end wall scraper blades 112. In some embodiments, each end wall scraper blade support 102 may include more than one end wall scraper blade 112. In some embodiments, cylindrical side wall scraper blades 108 and/or combined end wall and cylindrical side wall scraper blades 110 may be constructed to include an adjustable angle of pitch to facilitate processing of materials within dryer/grinder.

In some embodiments, the location of the cylindrical side wall scraper blades 108 and/or combined end wall and cylindrical side wall scraper blades 110 may be adjusted along shaft 48 within the interior of cylinder of the dryer/grinder. In some embodiments, the length dimension for the cylindrical side wall scraper blades 108 and/or combined end wall and cylindrical side wall scraper blades 110 may be increased or decreased as required to facilitate processing of alternative types or compositions of material within dryer/grinder. In some embodiments, the quadrants 88 and central ring 86 having cylindrical side wall scraper blades 108, and/or combined end wall and cylindrical side wall scraper blades 110 may be used within any portion 60, section 62, retention zone 64 and/or charge zone 66 within the cylinder for the dryer/grinder. In at least one embodiment, one or more assemblies including cylindrical side wall scraper blades 108, and/or combined end wall and cylindrical side wall scraper blades 110 may be positioned at any location along the shaft 48 within the interior of the dryer/grinder.

In some embodiments, the blades 108, 110, 112 may be formed of a thicker or thinner metal, composite, and/or other rigid material. In some embodiments, the blades 108, 110, 112 may be either increased or decreased in size or dimension, or increased or decreased number, and it is anticipated that every location and feature may be freely adjustable in each and every respect. In at least one embodiment, the clearance dimension between the cylindrical side wall 42 and/or end wall 44, and scraper blades 108, 110, 112 may be increased or decreased.

Figure 16:
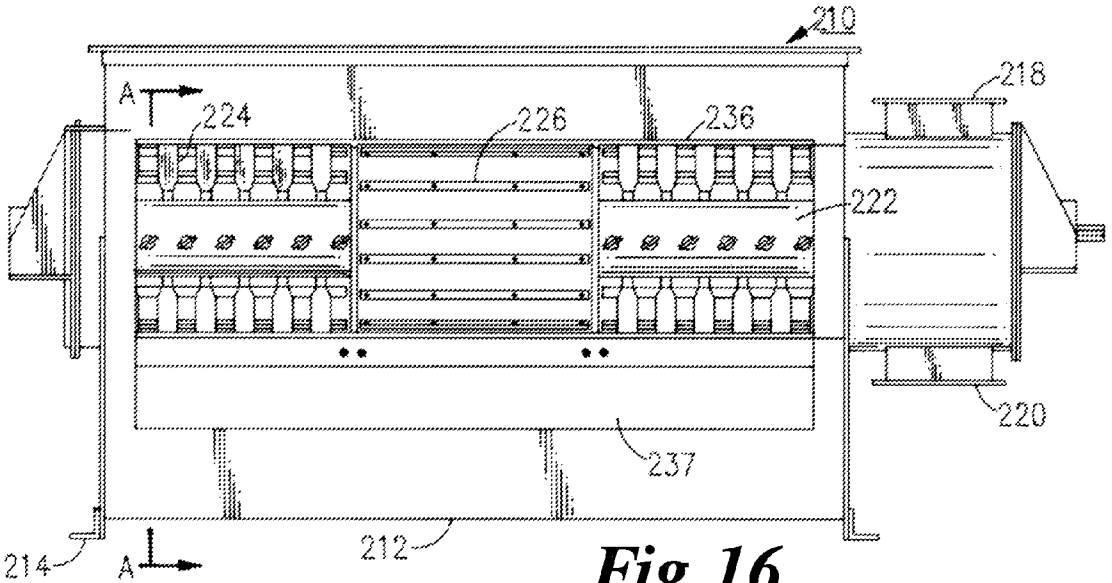
FIG. 16 illustrates a side cutaway view of a grinding apparatus in conformance with one embodiment of the present invention.

Referring to FIG. 16, a side cutaway view of one embodiment of a grinding apparatus 210 is illustrated. Grinding apparatus 210 may include a support structure 212 having mounting flanges 214 to position and support a cylindrical grinding chamber housing 236 which may be coupled to a product collection chamber 237. A product inlet port 218 may be used to introduce one or more desired products such as clay into the cylindrical grinding chamber housing 236 where the desired product(s) may be comminuted to a desired particle size. In at least one embodiment comminuting process may be achieved via a set of beaters/hammers 224 attached to a high speed rotating shaft 222. In at least one embodiment a set of hardened metal breaker bars 226 may be selectively attached to a portion of the inner surface of the cylindrical grinding chamber housing 236. In at least one embodiment as the shaft 222 rotates, at least a portion of the product entering the cylindrical grinding chamber housing 236 is forced into contact with and past the breaker bars 226 via the rotational movement of the beaters/hammers 224, thereby assisting in the comminuting of the product. In at least one embodiment, the rotation speed of the beaters/hammers 224 as well as the shape and pitch of the beaters/hammers 224 will determine the amount of time a particular product is being comminuted within the grinding chamber housing 236. In at least one embodiment, grinding apparatus 210 includes a product escape port 220 which may be utilized to remove foreign material that may inadvertently enter the comminuting chamber cylinder housing 236 before damage is caused to internal components of the grinding apparatus 210. In at least one embodiment, the foreign material may be forced into the product escape port 220 via the rotation action of the beaters/hammers 224. In at least one embodiment, the escape port 220 provides an enhanced level of operating safety and reliability for the grinding apparatus 210. In at least one embodiment, another discharge (see 304 in FIG. 25) at the opposite end of grinding apparatus 210 may be used to discharge the contents of the cylinder into a separate package.

Figure 17:
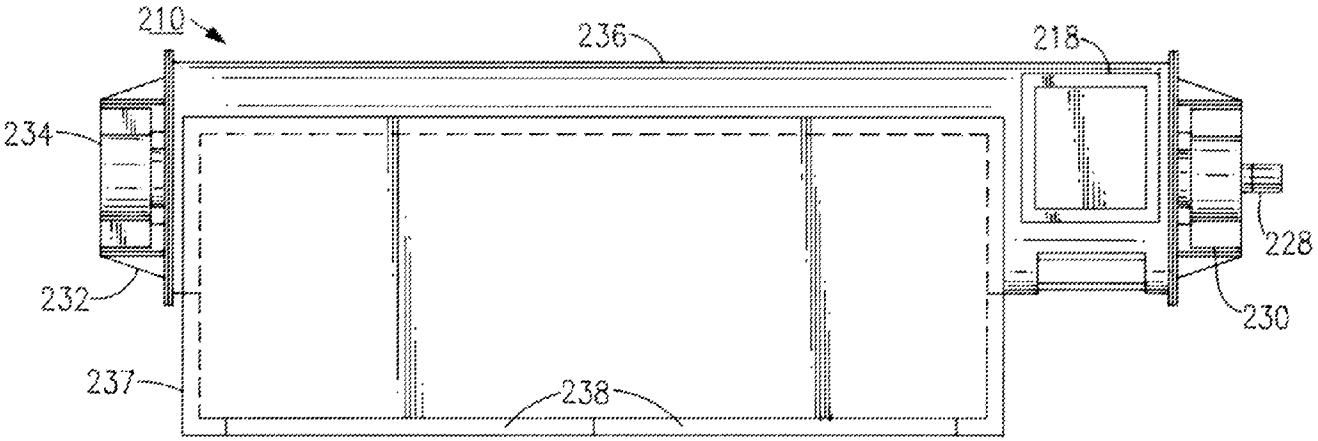
FIG. 17 illustrates a top view of one embodiment of the grinding apparatus shown in FIG. 16.

In at least one embodiment, FIG. 17 illustrates a top view of the grinding apparatus 210 shown in FIG. 16. The rotational shaft 222 may be supported at one end via a pillow block bearing 232 having an opening 234 sized to accept one end of the rotational shaft 222. The rotational shaft 222 may be supported at its opposite end via a second pillow block bearing 230. In at least one embodiment, a portion of the rotational shaft 222 may be reduced in dimension to form a drive shaft 228 which may be suitable for use with a totally enclosed, fan cooled (TEFC), variable speed drive motor (enumerated as 306 in FIG. 25). In at least one embodiment, other types of drive motors may be used to rotate the drive shaft 228, so long as the selected drive motor is capable of rotating the drive shaft 228 at the desired speed(s). One or more pulley assemblies (enumerated as 308 in FIG. 25) may be coupled to the drive shaft 228 such that a desired number of v-belts (enumerated as 307 in FIG. 25) may be used to coupled the variable speed motor 306 to the rotatable drive shaft 228. In at least one embodiment, the grinding apparatus 210 may be produced with or without a variable speed drive or without need of a v-belt. In at least one embodiment, the drive motor may be coupled directly to the grinder drive shaft 228. With continued reference to FIG. 17, in at least one embodiment, the product collection chamber 237 may include one or more access doors 238 to allow access to the beaters/hammers 224, breaker bars 226, or any other internal components within cylinder, without requiring removal of any spouting attached to the grinding apparatus 210, which may in turn, reduce undesirable down time during normal maintenance of the grinding apparatus 210.

Figure 18:
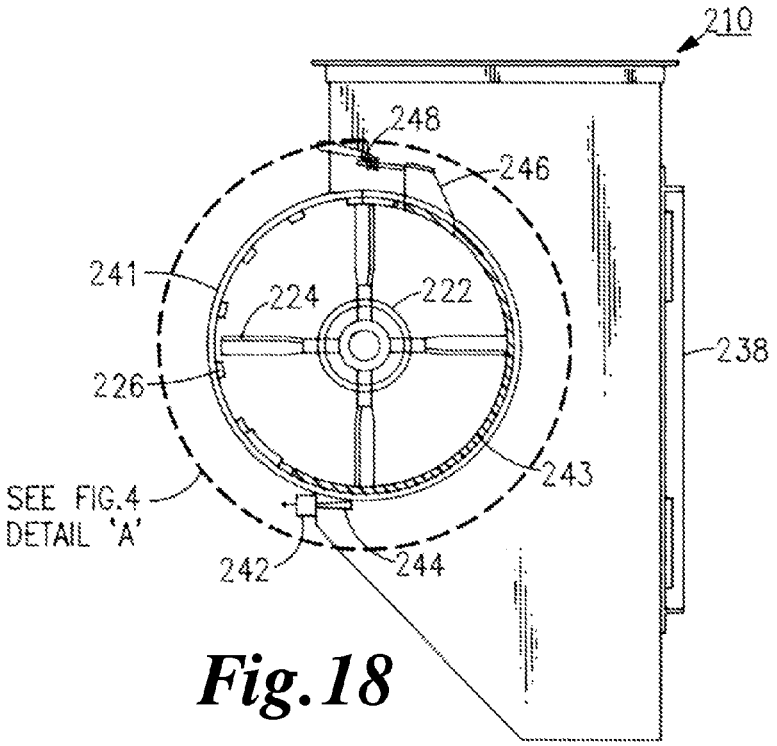
FIG. 18 illustrates a front end view of one embodiment of the grinding apparatus shown in FIG. 16.

FIG. 18 illustrates a partial front end view of at least one embodiment of the grinding apparatus 210 depicted in FIG. 16. It may be seen that opening the chamber access door(s) 238 allows easy access to any of the internal components, including but not necessarily limited to beaters 224, breaker bars 226, rotating shaft 222, eye bolt 244, and/or latches 248, which may require periodic maintenance. In at least one embodiment, the access door(s) 238 may allow for internal access to the product collection chamber 237 wherein comminuted product may be examined or removed from the product collection chamber 237 if so desired. In at least one embodiment, other chamber structures 237 and support structures 212 may be utilized so long as the grinding chamber housing 236 may be supported to accomplish the desired comminuting process.

Figure 19:
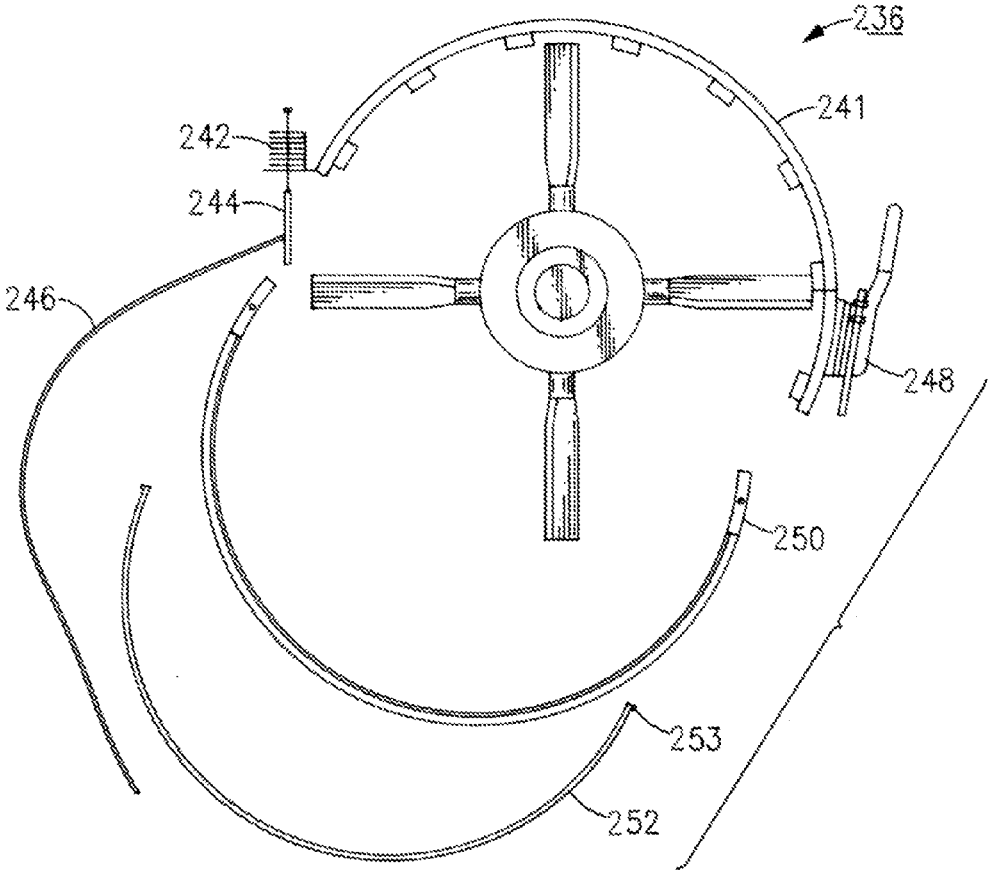
FIG. 19 illustrates a detailed view of a portion of one embodiment of the grinding apparatus shown in FIG. 16, depicting attachment of a grinding element in conformance with one embodiment of the present invention.

In at least one embodiment, FIG. 19 illustrates a portion of the grinding chamber cylinder housing 236 depicted as DETAIL "A" in FIG. 18. It may be seen that the cylindrical grinding chamber housing 236 may be formed partially by a solid arcuate element (wall portion) 241 while the remainder of the cylindrical grinding chamber housing 236 may be completed via a set of arcuate back bars 250 having keyways (enumerated as 257 in FIG. 26) and one or more arcuate grinding elements 252 having keys 253 for mating securely to the back bars 250 which in at least one embodiment may form a perforated arcuate element (wall portion) 243. In at least one embodiment, perforated arcuate element 243 of the cylindrical grinding chamber housing 236 may be formed by attaching one or more substantially straight back bars 250 to the arcuate grinding element(s) 252 and by placing the aforesaid substantially straight back bars 250 in a direction substantially perpendicular to the rotational path of the hammers 224. In at least one embodiment a plurality of chain elements 246 may be coupled to one end of the arcuate element 241 via a set of compression springs 242 and eye bolts 244. In at least one embodiment, alternative coupling mechanisms may be used to mate the solid arcuate wall element 241 and the perforated arcuate wall element 243 to form the cylindrical grinding chamber housing 236. The cylindrical grinding chamber housing 236 may be constructed by attaching the set of back bars 250 and arcuate grinding element(s) 252 to the arcuate element 241 via the chain elements 246 that are also attached to the opposite end of the arcuate element 241 via a set of tension latches 248 that engage the springs 242 to complete the assembly as illustrated in FIG. 19.

Figure 25:
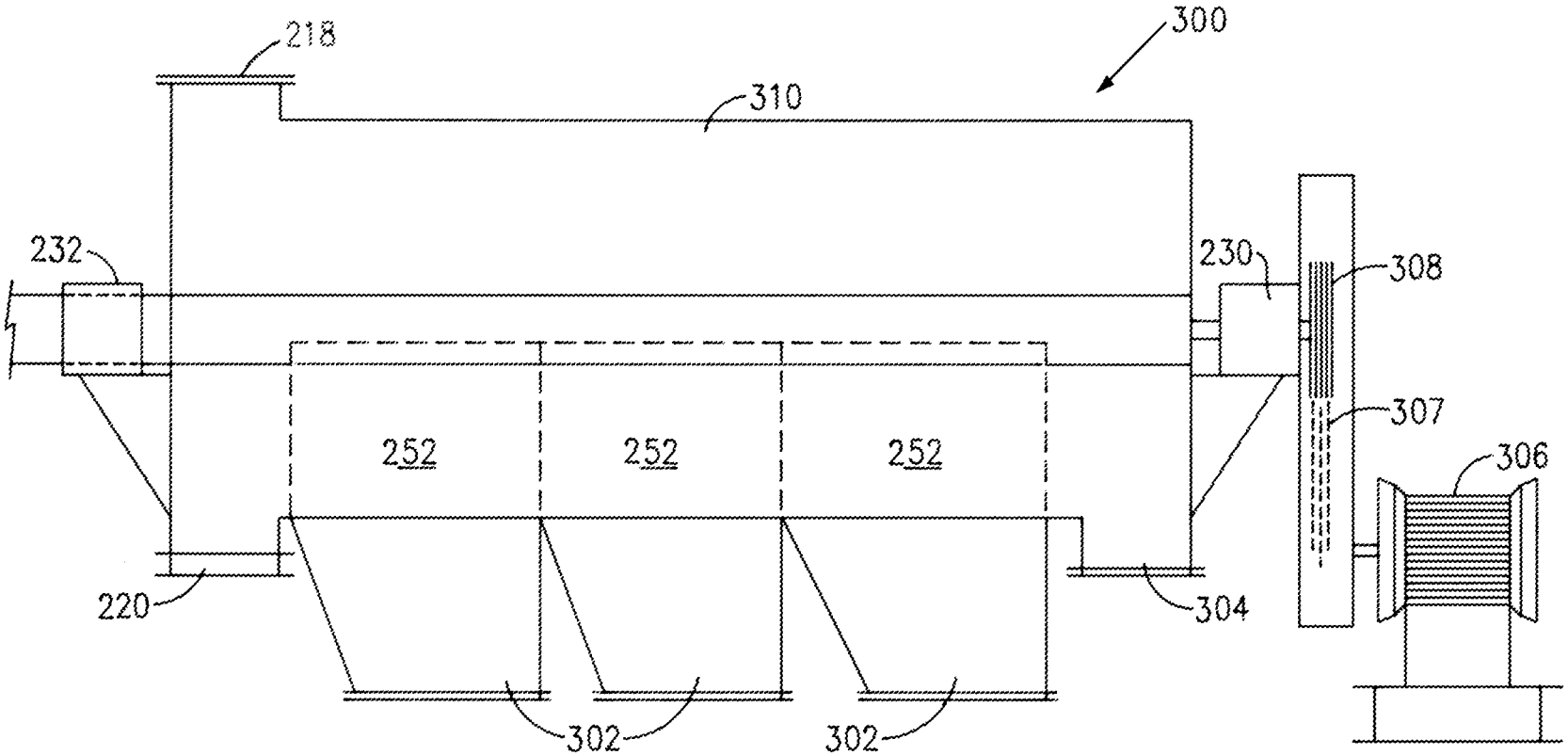
FIG. 25 illustrates a side view of a grinding apparatus in conformance with another embodiment of the present invention.

With continued reference to FIGS. 16-19, and with reference also to FIG. 25, in at least one embodiment, there is disclosed a grinding apparatus 210 comprising a substantially cylindrical product grinding chamber having a rotatable hammer assembly axially disposed there through, the rotatable hammer assembly having a plurality of circumferentially spaced hammers 224 defining a rotation path therein; at least one inlet port 218 through which at least one product can be introduced into the substantially cylindrical grinding chamber; at least one discharge port 302 through which any comminuted product can be discharged from the substantially cylindrical grinding chamber; a plurality of breaker bars 226 attached to selected portions of the periphery of the substantially cylindrical grinding chamber, each breaker bar 226 within the plurality of breaker bars 226 being substantially perpendicular to a tangent of the rotation path of the hammers 224 defined at each breaker bar 226; wherein the substantially cylindrical grinding chamber comprises a plurality or arcuate back bars 250, each arcuate back bar 250 within the plurality of arcuate back bars 250 being substantially parallel to a tangent of the rotation path of the hammers 224 defined at each back bar 250; and at least one arcuate grinding element 252 attached to the plurality of back bars 250 such that a first inside radius may be prescribed by the at least one arcuate grinding element 252 and a second radius prescribed by the plurality of breaker bars 226 are equidistant from a common central axis defined by the rotatable hammer assembly and the substantially cylindrical grinding chamber.

In at least one embodiment one or more grinding/pulverizing sections include one or more arcuate grinding elements 252 coupled to the inner surface of a cylindrical housing such that the radial distance between the axis of the rotating shaft 222 and the inner surface of the arcuate grinding elements 252 is identical with the radial distance between the axis of the rotating shaft 222 and the grinding/comminuting end surfaces of the beaters/hammers 224 (FIG. 19). The unique structural placement of the grinding elements 252 provides additional grinding action as the beaters/hammers 224 rotate past the grinding elements 252 such that the aforesaid grinding elements 252 participate in the comminuting process. In at least one embodiment a series of precisely sized ribs (back bars) is optionally attached to the selected portions of the inner surface of the pulverizing section(s) cylinder housing to act as a mounting structure for the selected grinding element(s) 252. A series of arcuate or substantially straight back bars can also be coupled to the arcuate grinding element(s) 252 to form a portion of the grinding chamber cylinder housing. In some embodiments the arcuate grinding element(s) 252 may be perforated or ribbed. The size of the back bars may be dependent upon the thickness of the selected grinding element(s) 252, which to a certain extent, is dependent upon the choice of material utilized to construct the aforesaid grinding element(s) 252. Because the working surfaces defined by the inner radius of the grinding element(s) 252 and the breaker bars 250 are equidistant from the central axis of the rotating shaft 222, the desired grinding/comminuting action occurs whenever the beaters/hammers 224 are moving past a grinding element 252 or a breaker bar 250.

Figure 20:
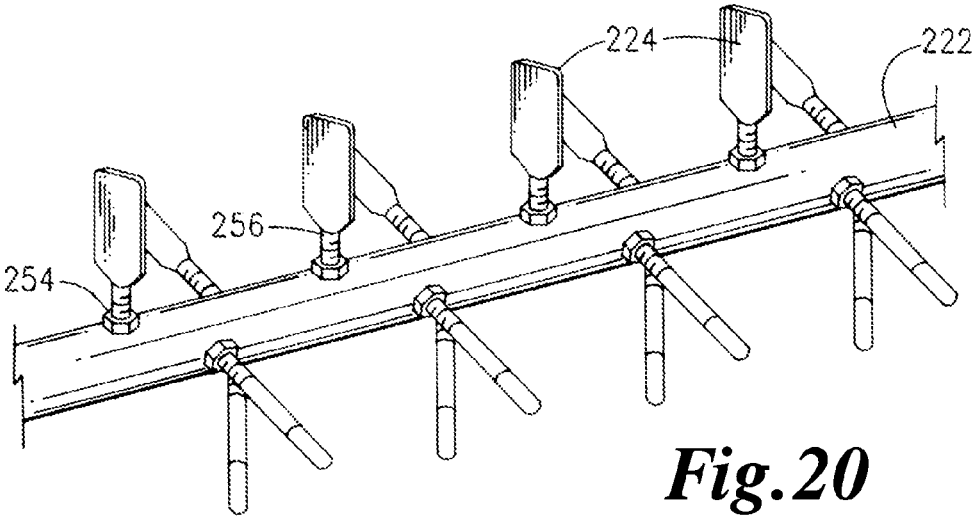
FIG. 20 illustrates a plurality of beaters/hammers coupled to a rotating shaft in conformance with one embodiment of the present invention.

In at least one embodiment as depicted in FIG. 20, a plurality of beaters/hammers 224 are shown coupled to a rotating shaft 222. The pitch of the beaters/hammers 224 are individually and selectively adjustable to control the slashing angle and grinding/cutting action of the beaters/hammers 224, and to control the rate of product flow through the grinding chamber cylinder housing 236 as discussed herein. In at least one embodiment, the pitch selection greatly aids in providing a fan action toward the discharge end of the grinding apparatus 210 such that it may become unnecessary to provide a negative air flow to accommodate dust removal from within the apparatus 210, therefore providing continuous cleaning action that reduces the necessity to implement a rigorous maintenance schedule commonly used with hammer mills, for example.

The length of the beaters/hammers 224 may also be individually and selectively adjustable via a tension nut 254 or other suitable fastening hardware, and a threaded neck 256 that forms a portion of each beater/hammer 224 to selectively and rigidly secure the desired pitch and hammer 224 length. In at least one embodiment, the adjustable length feature allows the operator to maintain a close tolerance between the ends of the beaters/hammers 224 and the working surfaces of the breaker bars 226 as well as between the ends of the beaters/hammers 224 and the working surfaces of the grinding element(s) 252, thereby optimizing the efficiency of the grinding apparatus 210.

Figure 21:
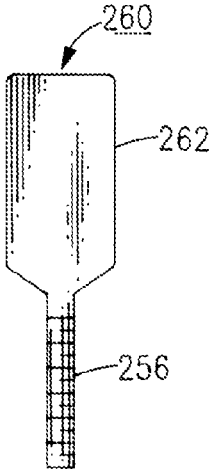
FIG. 21 illustrates one embodiment of a beater/hammer structure suitable for use with at least one embodiment of the present invention.

In at least one embodiment as depicted in FIG. 21 a beater/hammer structure 260 is shown. The beaters/hammers 224 in at least one embodiment have wide paddles 262 which are useful in some processing applications to ensure the entire surface area of the grinding element(s) 252 are traversed during the grinding process. In at least one embodiment, the wide paddles 262 are selectively constructed of a hardened base material, such as tungsten carbide, although any sufficiently hardened base metal, e.g. carbon steel, composite and/or other rigid material will provide the desired grinding action.

Figure 22:
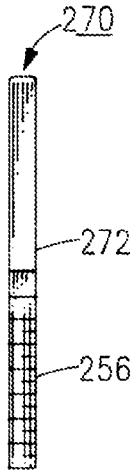
FIG. 22 illustrates another embodiment of a beater/hammer configuration suitable for use with at least one embodiment of the present invention.

In at least one embodiment, FIG. 22 illustrates an alternative beater/hammer configuration 270. The beater/hammer 270 may include a narrow paddle 272. In at least one embodiment, the narrow paddle configuration 272 provides a more efficient grinding process for some applications.

Figure 23:
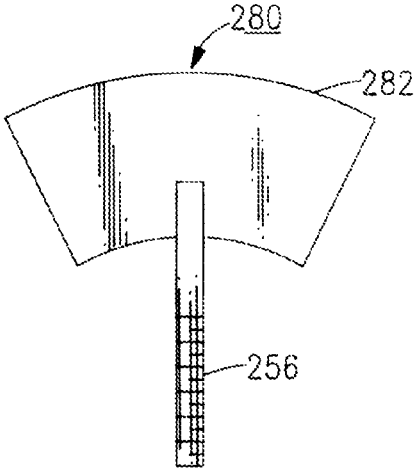
FIG. 23 illustrates yet another embodiment of a beater/hammer configuration suitable for use with at least one embodiment the present invention.

In at least one embodiment, FIG. 23 illustrates an additional alternative beater/hammer configuration 280. The beater/hammer 280 includes a very wide paddle 282. The very wide paddle 282 in at least one embodiment, prohibits wrapping action of certain materials. In some embodiments, the wider paddle configurations also traverse the entire surface of the grinding element(s) 252, thereby forcing more material into contact with the grinding element(s) 252 resulting in a more efficient grinding process.

Figure 24:
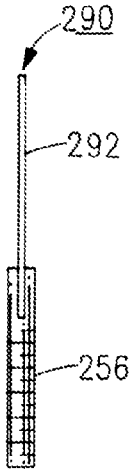
FIG. 24 illustrates still another embodiment of a beater/hammer configuration suitable for use with at least one embodiment of the present invention.

In at least one embodiment, FIG. 24 illustrates another beater/hammer configuration 290. The beater/hammer 290 may include a very narrow paddle 292. The very narrow paddle 292 may provide a more efficient grinding process for certain types of products, although a greater number of beaters/hammers 224 may be required in limited situations. In at least one embodiment, configurations including different combinations of paddle 292 structures provide improved comminuting when certain types of products or combinations of products as processed by the grinding machine 210. In some embodiments, factors which influence the type of beater/hammer(s) 224 selected and/or combinations of beater/hammer(s) 224 selected include, but are not limited to initial product size, type and strength; product type, e.g. dry (solid, moist, powder) or liquid, combinations of dry and liquid; adhesive characteristics; purity; and the like. For example, in some embodiments products that may be efficiently processed with the grinding apparatus 210 may include virtually any powder and/or liquid such as clay slurry's. In some embodiments involving product separation applications, the end discharge port (enumerated as 304 in FIG. 10) opposite the inlet end of the grinding apparatus 210 may also be necessary.

In at least one embodiment as depicted in FIG. 25, a side view of a grinding apparatus 300 may include multiple grinding elements 252. Individual grinding elements 252 may include a mesh shape which is the same as, or unique and distinct as compared to any mesh associated with a different grinding element 252, to facilitate comminuting of the product(s) into a desired particle size. In at least one embodiment, the processed product(s) may be collected into any desired number of collection chambers, to separate the final processed product(s), such that different particle sizes may be obtained from the grinding apparatus 300. In at least one embodiment, the grinding apparatus 300 may include an escape port 304 allowing removal of any piece of foreign material that may inadvertently enter the apparatus 300, before the foreign material may cause damage to any one or more of the grinding elements 252. For example, a piece of heavy metal would gravitate into the escape port 304 after it has been introduced through the feeder inlet 218 while the lighter product to be pulverized would be pulled into the grinding chamber (enumerated as 400 in FIG. 26) due to the aforesaid fan action of the beater/hammers 224. In at least one embodiment, the grinding apparatus 300 may include a v-belt drive unit 308 coupled to a variable speed motor 306 such that the rotational speed of the beaters/hammers 224 may be varied to accommodate a wide variety of products and product mixes. In at least one embodiment, a fixed speed drive motor may be used as directly coupled to a drive motor. In at least one embodiment, the grinding apparatus 300 has a cylinder 310 of sufficient length dimension to accommodate a grinding chamber length of up to 96-inches or longer. The lengthened grinding chamber provides for an increased number of breaker bar 226 and grinding elements 252 providing a grinding area substantially greater in size.

In at least one embodiment, the grinding apparatus 300 may be configured to function using a reverse rotation of the main drive shaft 228 simply by using a reversible drive motor in combination with rotating the hammer 224 assemblies. In this embodiment, a more even distribution of wear may be obtained for the sides of the hammers 224 and the breaker bars 226.

In at least one embodiment, with continued reference to FIG. 25 and FIGS. 16-24 and 26, a grinding apparatus 300 comprising: a substantially cylindrical grinding chamber defined by a solid arcuate wall portion 241 and a perforated arcuate wall portion 243; a plurality of rib members; at least one arcuate grinding element 252 coupled to the plurality of rib members provides an inner radius prescribed by the at least one arcuate grinding element 252; wherein the solid arcuate wall portion 241 forms a substantially cylindrical housing 236 defining the substantially cylindrical grinding chamber therein; a rotatable hammer assembly axially disposed through the grinding chamber, the rotatable hammer assembly having a plurality of circumferentially spaced hammers 224 defining a rotation path therein; at least one product inlet into the substantially cylindrical grinding chamber; at least one discharge for comminuted product exiting from the substantially cylindrical grinding chamber; and a plurality of breaker bars 226 attached to selected portions of an inner surface prescribed the solid arcuate wall portion 241, such that an inside radius defined by the plurality of breaker bars 226 and the inside radius defined by the grinding elements 252 may be equidistant from a common central axis prescribed by the rotatable hammer assembly and the substantially cylindrical grinding chamber.

Figure 26:
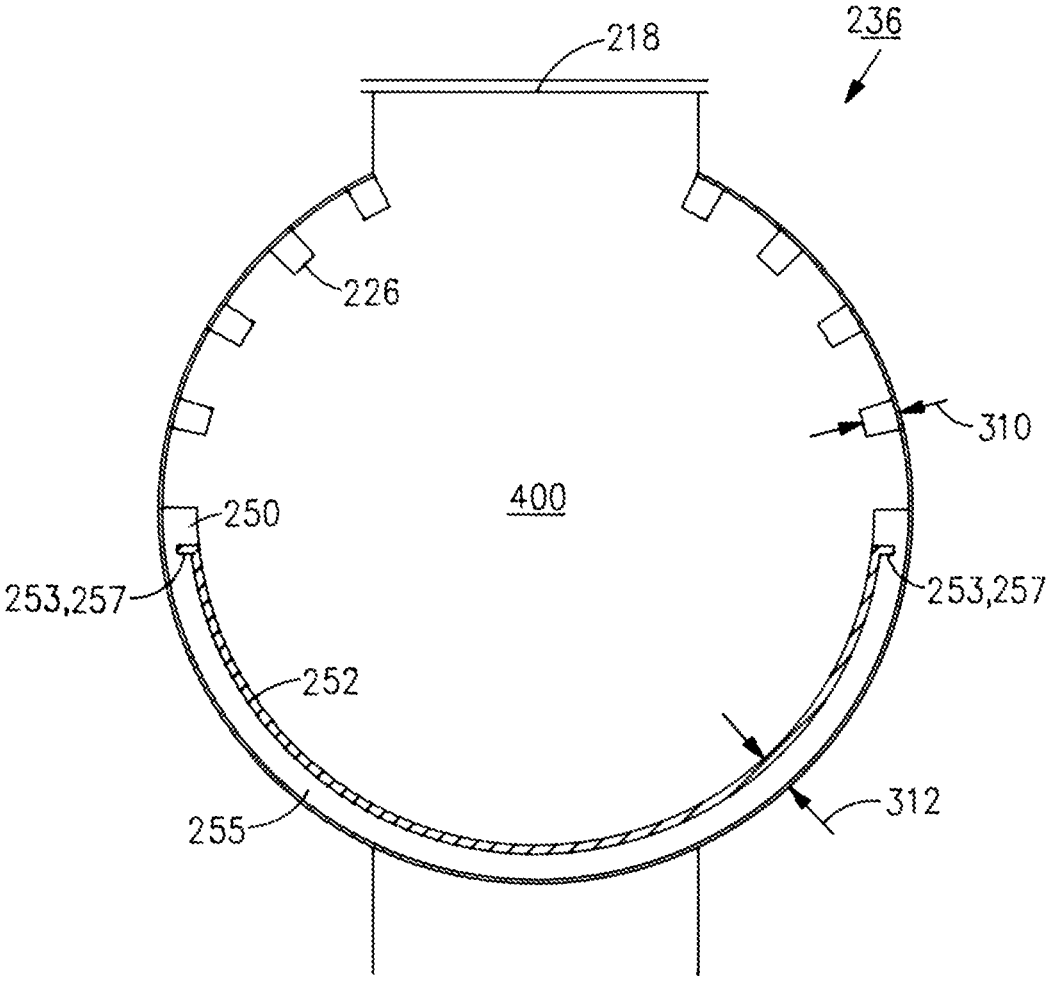
FIG. 26 is a detailed end view of a grinding section for the grinding apparatus shown in FIGS. 16 and 25, illustrating structural placement of a grinding element in conformance with one embodiment of the present invention.

In at least one embodiment as depicted in FIG. 26 a detailed end view of a grinding section for the grinding apparatus 210, 300 shown in FIGS. 16 and 25, illustrates structural placement of breaker bars 226 and a grinding element 252. The grinding chamber cylinder housing 236 may include the arcuate element 241, compression springs 242, eye bolts 244 and chains 246 illustrated in FIG. 19. In at least one embodiment, the grinding chamber 400 may include a plurality of identically sized breaker bars 226 attached to selected portions of the inner surface of the grinding chamber cylinder housing 236. A set of back bars may also be attached to selected portions of the inner surface of the grinding chamber cylinder housing 236. The back bars may include a recessed portion including a keyway 257 adapted to removably receive a predetermined size grinding element 252. In at least one embodiment, the inner surfaces of the breaker bars 226 and the inner surface of each grinding element 252 are equidistant from the axis of the rotating shaft 222. The equidistant feature is achieved by ensuring the thickness of the breaker bars 226 is identical with the combined thickness of the back bars and the attached grinding elements 252. In at least one embodiment, a thick grinding element 252 will require a deeper recess than a thin grinding element 252 that will require a more shallow recess within the associated back bar. In at least one embodiment, the grinding apparatus 210, 300, 400 uses the grinding elements 252 to enhance and optimize the desired grinding/pulverizing process. In at least one embodiment, the grinding chamber cylinder housing 236, may have a single unitary wall or may be formed of multiple sections.

In at least one embodiment, the material to be processed by the combination dryer/grinder 402 has an approximate moisture range prior to processing of between 10% and 30%. In some embodiments the material to be processed does not seem to be able to hold any more than 30% moisture, like wet sand, it becomes saturated when exposed to a certain amount of moisture. In at least one embodiment, the material processed by the combination dryer/grinder 402 has an approximate moisture content after drying of between 0.5% to 10%.

In some embodiments, the material to be processed by the combination dryer/grinder 402 includes but is not necessarily limited to Crude Kaolin Clay, Attapugite Clay, Magnesium Hydroxide, Calcium Carbonate, Talc, Gypsum (including wallboard), Municipal Biosolids, and/or Compost, etc. In some embodiments the dryer/grinder 402 may be used in other industries, for the processing of other types of materials, and is not restricted to the processing of the materials identified herein.

In some embodiments, the initial moisture content of materials prior to the initiation of processing by the grinder/dryer 402 may be as follows: Crude Kaolin Clay (15-25% moisture), Attapulgite Clay (35-50% moisture), Magnesium Hydroxide (45-65% moisture), Calcium Carbonate (25-65% moisture), Talc (15-65% moisture), Gypsum (15-65% moisture), Municipal Biosolides (65-85% moisture), and Compost (25-75% moisture). In some embodiments, the range of moisture content as identified herein, may vary considerably dependent on the desired application.

At least one embodiment of the dryer/grinder 402 is depicted in FIG. 27. The dryer/grinder 402 may include a dryer as described herein, in airflow communication with a hot air inlet 404. A drive unit 406 including an engine or motor located proximate to the inlet end 410 may be engaged to a drive shaft 408. A product inlet 412 may provide material flow communication into the interior of the cylinder 414. The material transfer apparatus including a hopper may be in material flow communication with the product inlet 412.

In at least one embodiment, a plurality of agitator disk or scraper blade assemblies 82 may be engaged to the shaft 408 within the cylinder 414 proximate to the inlet end 410. Drive shaft 408 may also be engaged to pillow block 232 proximate to the inlet 410. In at least one embodiment, one or more agitator disks or scraper blade assemblies 82 may be located at any desired position along drive shaft 408, and are not restricted to positioning adjacent to inlet end 410 within cylinder 414.

In at least one embodiment, each agitator disk or scraper blade assembly 82 may include a plurality of blade supports 96 and combined end wall and cylinder side wall scraper blades 110; end wall scraper blades 112; and/or cylindrical side wall scraper blades 108 as described here in.

In at least one embodiment, drive shaft 408 may also include a plurality of adjustable beater blades 50; material dams 72, 70 and shaft mounted air dams 68 as earlier described. In at least one embodiment, the number, location, and relative positioning of the beater blades 50, material dams 70, 72, and/or shaft mounted air dams 68 may be adjustably engaged at any desired location along shaft 408.

In at least one embodiment, the dryer/grinder 402 includes a product and air outlet 416 which may be proximate or engaged to discharge end 418 of cylinder 414. In at least one embodiment, drive 408 may also be rotatably engaged with a second pillow block 232 proximate to a discharge end 418.

In at least one embodiment, the interior of the cylinder 414 of the dryer/grinder 402 may be set up into a plurality of processing sections or zones 420. An initial processing section 420, proximate to the inlet end 410, may include one or more agitator disk or scraper blade assemblies 82. Adjacent to the agitator disk or scraper blade assemblies 82 may be located in an initial drying chamber 422. A screen 424 may be engaged to a material dam 70, 72 inside cylinder 414 to facilitate retention of moist material and/or larger material within the initial processing section 420, until such time as the moisture content and relative size of the material has been reduced to a desirable level to permit passage into subsequent processing sections or chambers 420. In at least one embodiment the grinding members 426 are not used within, or engaged to, the interior wall of the cylinder 414 within the initial drying chamber 422 and/or initial processing section 420.

In at least one embodiment, the moisture content for the material to be processed in the initial drying chamber 422 may be sufficiently moist to fill any opening, spacing between ribs, spacing between channels, or may fill any space between any structure provided within a grinding member 426. In at least one embodiment, grinding members 426 may be used in a processing section 420, down stream from the initial drying chamber 422.

In at least one embodiment, the elements, features, and/or functions of the shaft mounted air dams 68 and/or material dams 70, 72, as earlier described, are equally applicable to shaft 408 and cylinder 414 within dryer/grinder 402.

In at least one embodiment, screen element 424 within cylinder 414 may include any properties, size openings, or may be formed of any desirable material which is sufficient to satisfy requirements of a particular application. In at least one embodiment, screen element 424 facilitates retention of material to be processed within the initial processing zones of sections 420, and initial drying chamber 422, for a sufficient duration of time to adequately reduce size of the material being processed and reduce the moisture content of the material being processed.

In at least one embodiment, the screen 424 may have a circumference for positioning adjacent to the interior wall of the cylinder 414. The screen 424 may also include a central opening adapted for positioning in surrounding relationship to shaft 408, permitting free rotation of shaft 408 during processing of material within dryer/grinder 402. In at least one embodiment, the circumference of the screen 424 may be engaged to the interior wall of the cylinder 414 by any desired affixation device including, but not necessarily limited to the use of, welding, bolts and nuts, screws, and/or clamps. In some embodiments, the screen 424 may be fixedly or releasably secured to supports which may be integral or releasably attached to the interior of the cylinder 414.

In at least one embodiment, the screen 424 extends from a position adjacent to the interior wall of the cylinder 414 to a location proximate to the exterior circumference of the shaft 408. In other embodiments, the screen 424 will extend from the interior wall of the cylinder 414 a desired distance towards the shaft 408, leaving a desired space or gap between the central opening of the screen 424 and the exterior circumference of the shaft 408. The space or gap between the screen 424 and the shaft 408 will be as large or as small desired to facilitate the retention of the material within initial processing section 420, or initial drying zone 422.

In at least one embodiment, the duration of time in which material is retained in the initial processing section 420 and/or initial drawing chamber 422, is regulated by a combination of the pitch provided for the scrapper blades 108, 110, 112 the relative size of the initial drying chamber 422 and the properties selected for the screen element 424.

In at least one embodiment, individual scraper blades 108, 110, 112 may have a pitch offset which is the same or different with respect to an adjacent scraper blade 108,110,112 or other scraper blade 108, 110, 112 which may be positioned at another location upon agitator disk assembly 82. In at least one embodiment, any desired pitch for the scraper blades 108,110,112 may be angularly offset with respect to another scrapper blade 108,110,112 in order to assist in the retention of material in the initial processing zone 420 and/or initial drying chamber 422.

In at least one embodiment, the offset for the angles for the pitch for scrapper blades 108,110,112 may be similar to the angle of pitch for the beater blades 50 as described herein. In at least one embodiment, the support structure for the scrapper blades 108,110,112 may be modified to be the same as, or similar to, any individual feature as related to the beater blades 50 in order to facilitate adjustability and/or flexibility with respect to set up and operation of the dryer/grinder 402 to accomplish performance optimization during the processing and classification of materials.

In at least one embodiment as shown in FIG. 27, four agitator disk or scrapper blade assemblies 82 are depicted. In at least one embodiments, the number of agitator disk or scrapper blade assemblies 82 within the initial processing section 420 may be increased or decreased as desired. In at least one embodiment, the diameter dimensions and/or the size and/or the length dimensions for the initial processing section 420 and/or initial drying chamber 422 may be adjusted in order to accommodate processing requirements associated with alternative types and moisture contents of materials.

In at least one embodiment, one or more agitator disk or scrapper blade assemblies 82, and/or alternative drying chambers 422, may be disposed at any desired position between inlet end 410 and discharge end 418 of dryer/grinder 402. In at least one embodiment, one or more screens 424 may be utilized at any desired location between inlet end 410 and discharge end 418 with in cylinder 414 or dryer/grinder 402.

In at least one embodiment, the cylinder 414 may have diameter dimension of as small as approximately 12 inches and as large as 84 or 96 inches. In at least one embodiment, the diameter dimension for the cylinder 414 of the dryer/grinder 402 is dependent upon any number of considerations including, but not necessarily limited to materials to be processed, moisture content of the materials to be processed, and/or flow through speed for the dryer/grinder 402.

In at least one embodiment, a screen 424 my positioned approximate to the product and air outlet 416 or at a product discharge to assist in the classification of materials according to size, retention time of materials within the interior of the cylinder 414, and/or to influence the fluid dynamics of the transport of the materials within the material processing system.

In at least one embodiment, the division of the interior of the cylinder 414 into zones 420 facilitates material classification as according to size and moisture content. In at least one embodiment, classification of materials within the cylinder 414 will occur as a result of a process similar to angular momentum or inertia. In at least one embodiment, the division of the interior of the cylinder 414 into zones 420 occurs in order to distribute the drying function along the length of the cylinder 414 as well as to classify that the properties of the material within each processing zone 420, such as keeping materials having a larger moisture content up stream, permitting material passage towards the discharge 418 only after the moisture content for the material has been reduced to an extent where the material may pass over a shaft mounted air dam 68 or a cylinder mounted material dam 70, 72.

In at least one embodiment, the division of the interior of the cylinder 414 into processing sections or zones 420 occurs in order to distribute the classifying and/or grinding function along the length of the cylinder 414. In at least one embodiment, larger sized materials are retained up stream during processing, permitting material passage towards the discharge end 418 only after the size of the material has been reduced to an extent where the material may optionally pass through a screen 424 or over a shaft mounted air dam 68 or a cylinder mounted material dam 70, 72.

In at least one embodiment, the shaft air dam 68 and/or material dam 70, 72 may include relief openings which may be constructed of plate, screen, or constructed of plate and screen. In at least one embodiment, any desired number of shaft mounted air dams 68 and/or material dams 70 may be used along the length dimension of the cylinder 414. In at least one embodiment, the height dimension selected for the shaft mounted air dam 68 and/or material dam 70, 72 may be individually, sequentially, alternatively, and/or randomly adjusted in size for processing of materials within the dryer/grinder 402.

In at least one embodiment as depicted in FIG. 27, a shaft 408 is generally disclosed. In at least one embodiment, the shaft 408 may be in the form of a cylinder, or a cylinder surrounding an interior shaft. In at least one embodiment, the shaft 408 may include a plurality of openings. In at least one embodiment, the openings may be disposed in rows, sections, or according to a desired pattern, in the shape of a helical screw, and/or any other desired pattern, configuration, or combination of patterns, configurations, and sections, including random placement along the length dimension of the shaft 408. In at least one embodiment at least 4 to 6 rows of openings are provided on shaft 408.

In some embodiments, the shaft 408 may have a diameter dimension of about 6 inches up to about 30 inches, dependent upon the size dimension for the diameter of the cylinder 414 of the dryer/grinder 402. In at least one embodiment, the rotational speed of the shaft 408 within the cylinder 414 may be constant or variable. In some embodiments, the speed of rotation of the shaft 408 within the cylinder 414 is dependent upon the diameter dimensions for the cylinder 414. In some embodiments the speed of rotation of the shaft 408 is reduced as the diameter dimensions for the cylinder 414 is increased.

In at least one embodiment, the speed of rotation of the shaft 408 within the dryer/grinder 402 having a cylinder 414 with a diameter dimension of 20 inches will be between 600 and 1200 rotations per minute, thereby providing a tip speed for the paddles 442 of a range between 3100 and 6300 feet per minute. In some embodiments, the speed of rotation of the shaft 408 may be as high as 1500 RPM. In some embodiments the efficiency of the dryer/grinder 402 is reduced as the speed of rotation of the shaft 408 is reduced. In other embodiments it is contemplated that speed of rotation of the paddles 442 may be as fast as 12000 feet per minute. In some embodiments this speed of rotation of the shaft 408 is adjusted as dependent upon the length dimension for the shaft 408 and/or cylinder 414.

In at least one embodiment, the openings are constructed to receive a support sleeve 432 for a beater blade 50. In at least one embodiment the interior of openings and exterior of the support sleeve 432 may be threaded for engagement there between. In at least one embodiment, the support sleeves 432 are fixedly attached or releasably engaged to openings along shaft 408. In other embodiments, the support sleeves 432 may be fixedly or releasably engaged to a respective opening by any desired mechanical attachment including the use of bolts, nuts, welding, screws, etc. In at least one embodiment, the openings along the shaft 408 have either regular or irregular spacing between adjacent openings.

In at least one embodiment, the support sleeves 432 may be formed of either a tube or a shaft having a receiver. In at least one embodiment, the support sleeves 432 are adapted to releasably or fixedly receive a neck 434 of a beater blade 50. In at least one embodiment, a clamp 436 is engaged to the top of a respective support sleeve 432. In at least one embodiment, the clamp 436 may be a clasp, or any other mechanical device to secure neck 434 and beater blade 50 to support sleeve 432 and shaft 408. In at least one embodiment, the clamp 436 may be tightened about the top of the support sleeve 432 to apply friction to secure neck 434 to support sleeve 432.

In at least one embodiment, the interior of the support sleeve 432 includes threads for engagement to threads on the exterior surface of the neck 434. In some embodiments, the releasable engagement between the support sleeves 432 and the openings facilitates replacement do to wear. In some embodiments the releasable engagement between the support sleeves 432 and the openings facilitates the reconfiguration of the beater blades 50 along the shaft 408 to improve performance of the dryer/grinder 402. In other embodiments, the releasable engagement between the necks 434 and support sleeves 432 facilitates replacement of the beater blades 50 do to wear. In some embodiments, the releasable engagement between the necks 434 and the support sleeves 432 facilitates replacement, reconfiguration, and/or adjustment of size of the paddles 442 to improve performance of the dryer/grinder 402.

Figure 28:
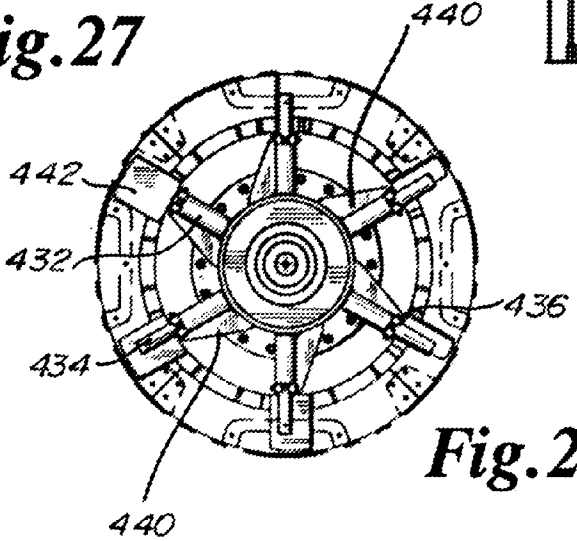
FIG. 28 is an alternative cross sectional end view of one embodiment of the grinder/dryer.

In at least one embodiment, selected support sleeves 432 and beater blades 50 may be removed from selected openings and replaced within other openings along shaft 408. In at least one embodiment, removable plugs may be disposed within openings which are empty of support sleeves 432. In at least one embodiment, plugs may be used to prevent accumulation of material within unused openings. In at least one embodiment, support sleeve 432 include a brace 440 which may be used to add structural support to support sleeve 432 during rotation of shaft 408 and operation of dryer/grinder 402 (FIG. 28).

In some embodiments, necks 434 may be rotatable 360 degrees relative to support sleeves 432 to provide any desired angle of pitch for the paddles 442 of beater blades 50. In some embodiments the adjustable location of necks 434 relative to the support sleeves 432 allows the angles of pitch for paddles 442 to be adjusted to regulate the time material is processed within individual processing sections 420 within cylinder 414.

In some embodiments, the paddles 442 may be larger or smaller in size as earlier described. In other embodiments, the pitch for the paddles 442 may be at any desired angle from parallel to the shaft 408 to perpendicular to the shaft 408 and/or may be set in a neutral, forward, or retention configuration to regulate the passage of material within cylinder 414 toward discharge end 418. In some embodiments, the paddles 442 may have dimensions which vary from about 3 inches square to about 12 inches square, dependent upon the size of the interior diameter dimensions utilized for the dryer/grinder. In some embodiments, the paddles 442 are shaped other than square, such as rectangular and/or may include 1 or more arcuate edges.

In some embodiments, the paddles 442 may be securely engaged to the necks 434 by welding. In other embodiments, paddles 442 may be engaged to the necks 434 through the use of any suitable mechanical device including screws and/or nuts and bolts. In some embodiments, the paddles 442 are permanently or releasably attached to the necks 434 of the beater blades 50.

In some embodiments, the clamp 436 may be tightened by the manipulation of screws and/or Allen screws. In some embodiments, the clamp 436 may be formed of bolts, nuts and/or lock washers. In other embodiments, the clamp 436 is an alternative mechanical device used to securely and/or releasably attach a neck 434 to a support sleeve 432. In some embodiments, the clamp 436 may be a rotational adjustment mechanism such as a lock washer and nut which may be directly attached to an opening eliminating the need for the use of a support sleeve 432. In at least one embodiment, the neck 434 of a beater blade 50 may be directly engaged to an opening within shaft 408.

In at least one embodiment, all of the elements identified here in may be formed of metal or other suitably rigid material having sufficient strength to withstand forces associated with the grinding and/or reducing of materials as disclosed herein.

Figure 29:
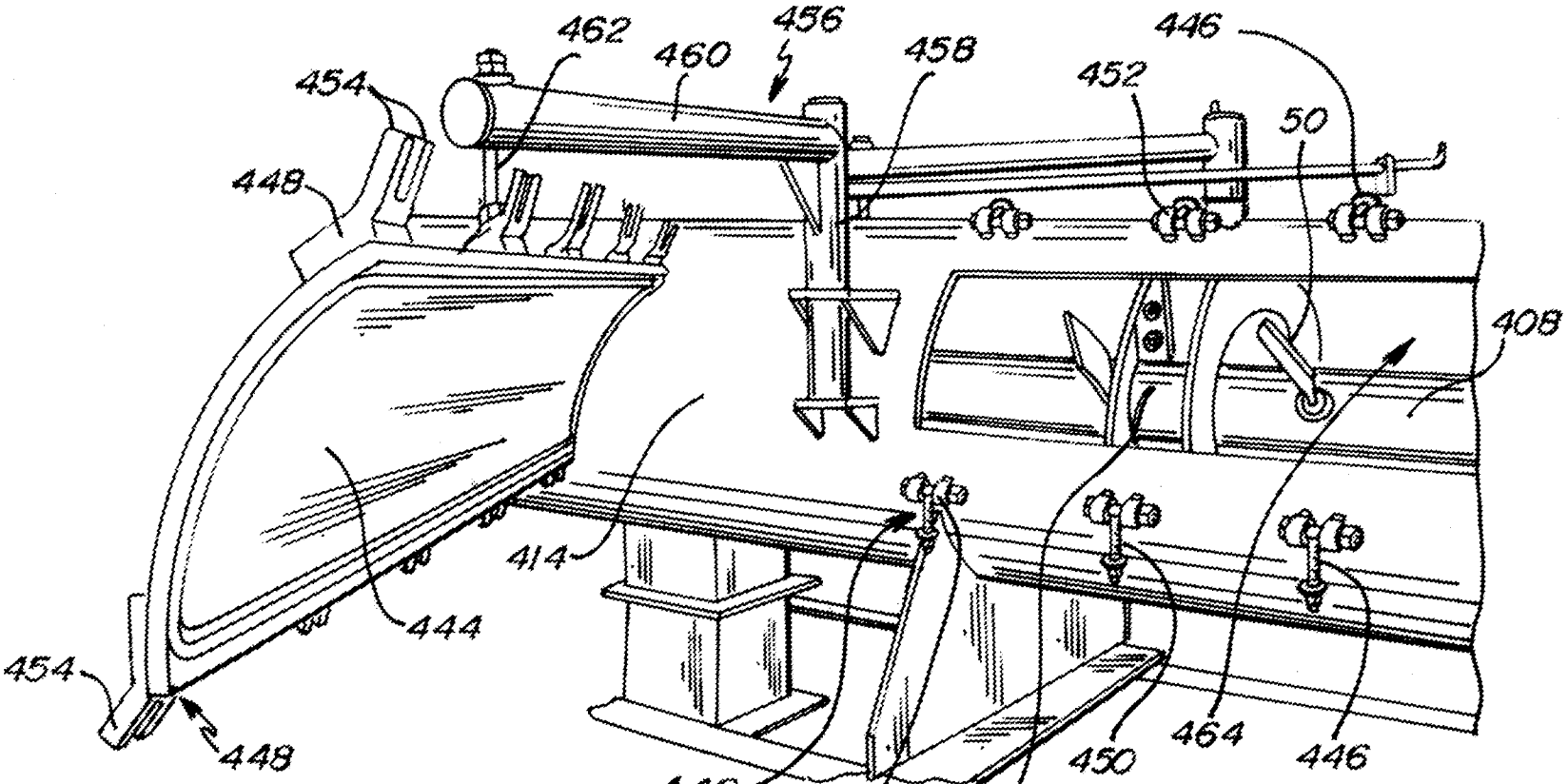
FIG. 29 is a perspective view of one embodiment of the grinder/dryer.
Figure 32:
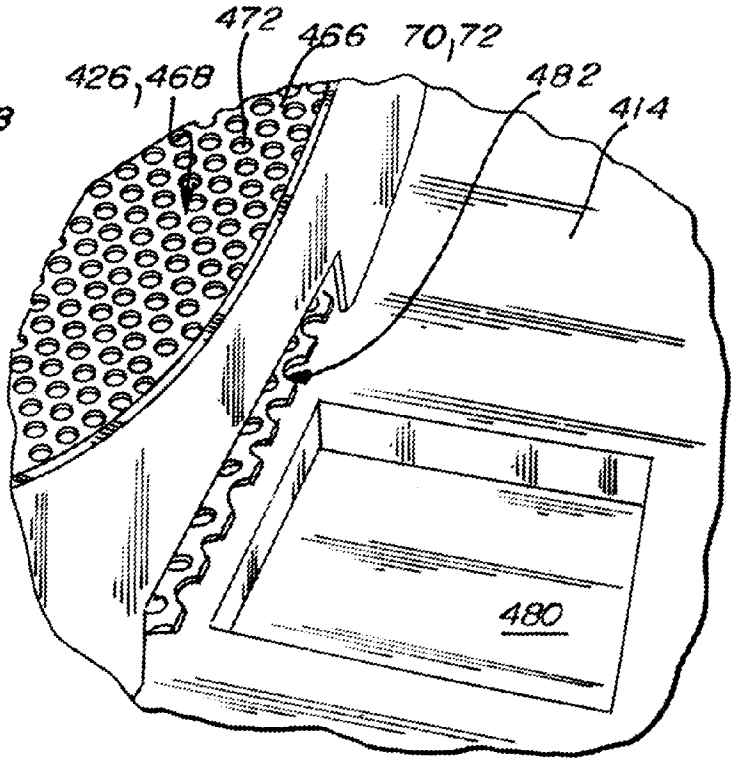
FIG. 32 is a partial cut away detail view of one embodiment of a grinding member, cylinder mounted material dam, and waste port.
Figure 34A:
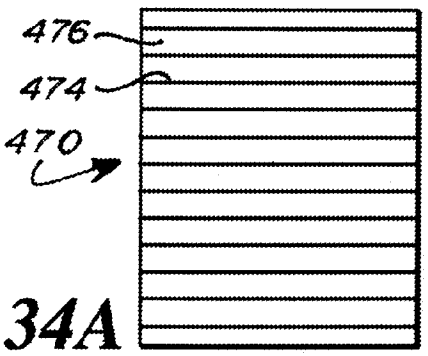
FIG. 34A is a top detail view of one embodiment of a grinding plate.

In at least one embodiment, as depicted in FIG. 29, at least one, or a plurality of doors 444 may cover openings 464 which traverse cylinder 414 providing access to shaft 408, beater blades 50, agitator disc or scrapper blade assemblies 82, material dams 70, 72, shaft mounted air dams 68, and/or grinding members 426. In at least one embodiment, doors 444 are located exterior to cylinder 414. In some embodiments, the doors 444 may be secured to the cylinder 414 through the use of attachment clamps 446 on the cylinder 414 which engage attachment brackets 448 on doors 444. In at least one embodiment, the attachment clamps 446 may be formed of an affixation bolt 450 which is pivotally attached to the exterior of the cylinder 414 through the use of a pivot bracket 452. In at least one embodiment, an adjustable nut and washer may be engaged to affixation bolt 450. In some embodiments, attachment brackets 448 may include a pair of tongs 454 to define a slot therebetween. In at least one embodiment, affixation bolt 450 is adapted for positioning through slot between tongs 454 whereupon the nut and washer of the affixation bolt 450 engage the exterior of the tongs 454. The rotational tightening of the nut and washer against tongs 454 thereby secures a door 444 to exterior of cylinder 414. In at least one embodiment, attachment bracket 448 is welded to the exterior of door 444.

In at least one embodiment, as depicted in FIG. 29 pivotal swing arm 456 may be used to position doors 444 to cover openings through cylinder 414. In at least one embodiment, pivotal swing arm 456 may include vertical support 458 and horizontal support 460. At distal end of horizontal support 460 may be located vertical pivot member 462. In at least one embodiment, swing arm 456 conveniently positions doors 444 over openings 446 which in turn, provides access into interior of cylinder 414.

In at least one embodiment as depicted in FIGS. 30A-30D, 31 and 32 arcuate shaped grinding members 426 may be positioned adjacent to the interior wall of the cylinder 414. The arcuate shape for the grinding members 426 may match the arcuate shape for the interior wall of the cylinder 414.

In other embodiments, the grinding members 426 may have structural elements 466 which facilitate the breakdown and/or classification of material being processed within the dryer/grinder 402. In some embodiments, the grinding members 426 may be heavy duty screen elements 468, grinding plate 470, grinding bars, grinding protrusions, grinding pins, and/or any other sturdy or rigid structure which assists in the reduction and classification of materials as processed within the dryer/grinder 402.

In at least one embodiment, the grinding members 426 may be positioned adjacent interior walls cylinder 414 at any desired location. In other embodiments, the grinding members 426 may completely cover the interior surface of the interior wall of one or more processing sections 420 of cylinder 414. In at least one embodiment a space may exist between adjacent grinding members 426 within cylinder 414. Grinding members 426 may also be engaged or attached to the interior surface of doors 444. In some embodiments, the grinding members 426 are not utilized within an initial processing section 420 and/or initial drying chamber 422 do to the initial moisture content for the material being processed, which may fill and/or clog any space between existing structural elements 466. The performance of grinding members 426 may be enhanced when used with materials having a lower moisture content.

In some embodiments, the grinding members 426 may be fixedly and/or releasably engaged to the interior of the cylinder 414 by mechanical attachment elements including, but necessarily limited to, the use of bolts and nuts, screws, welding, and/or clamps. The grinding members 426 may be adjustably positioned and/or repositioned within the interior of cylinder 414 to enhance the performance during the reduction/classification of materials processed within the dryer/grinder 402. In some embodiments, adjustable positioning of the grinding members 426 may be beneficial, in order to accommodate for variations between the composition and/or moisture content of materials to be classified/processed. For example, in at least one embodiment, during processing of very moist material, the use of the grinding members 426 may be downstream loaded within cylinder 414, in order to provide an enlarged or an additional drying chamber 422. In at least one alternative embodiment, materials to be dried and classified may be exposed to a processing section 420 having beater blades 50 prior to the exposure of the materials to processing sections 420 including beater blades 50 and grinding members 426.

In some embodiments, the grinding members may be rectangular, square, arcuate, and/or any other shape as desired. In at least one embodiment, the rectangular grinding members 426 may have dimensions of width of less than 8 inches and longer than 43 inches. In some embodiments, the rectangular grinding members 426 may have length dimensions of great than, less than, or equal to 43 inches, dependent upon the circumference dimensions selected for the cylinder 414. In at least one embodiment, the grinding members may have a thickness dimension less than, equal to, or greater than 2½ inches or greater than, equal to, or less than ½ inch. In other embodiments, the thickness dimension selected for the grinding member 426 may be based upon any number of factors including the hardness of the material to be classified, the size of the cylinder, the moisture content of the initial material to be dried, and/or the rotational speed the shaft 408.

In at least one embodiment, grinding members 426 may be formed of heavy duty screens which may include any desired shape or opening 472 including, but not necessarily limited to, circular, square, rectangular, triangular, pentagon, hexagon, octagon, and/or other geometrical or non geometric shapes as desired. In other embodiments, the shape of the openings 472 may be different between adjacent grinding members 426. In at least one embodiment, grinding member 426 having different shaped openings 472 may be interchangeable with other grinding members 426. In at least one embodiment, the shape and/or size of the openings 472 within grinding members 426 may change between processing sections 420 within cylinder 414. In some embodiments, openings 472 in grinding members 426 may be of different size between adjacent grinding members 426 or even within the same grinding member 426. Alternatively, any desired configuration of grinding members 426 may be established or changed within cylinder 414 such that different types of grinding members 426 may be mixed and/or matched within cylinder 414 during processing of a desired type of material.

In at least one embodiment as depicted in FIGS. 33 and 34A-34H grinding plates 470 may have any desired number, shape, and/or configuration or pattern of elevated ridges 474 or valleys or channels 476. In at least one embodiment, the adjacent relationship between the elevated ridges 474 and the valleys 476, as well as the structural elements 466 and adjacent openings 472 provide ridged contact surfaces which are struck by material during operation of the dryer/grinder 402. In at least one embodiment, high speed rotation of the shaft 408 causes high speed rotation of the beater blades 50 and paddles 442 which cause material within cylinder 414 to accelerate and to strike at an increased velocity the elevated ridges 474, and/or structured elements 466, thereby causing material to be classified/reduced into smaller particles and/or dust. The continued high speed rotation of shaft 408, and the pitch selected for the paddles 442, establishes a duration of time for material to be within a particular processing section 420, and thereby exposed to a desired type, number, and/or configuration of grinding members 426 within cylinder 414. In at least one embodiment, classification of material into a desired particle size or dust may thereby be accomplished by regulation of the speeds of rotation for shaft 408, and pitch for paddles 442, as well as the configuration for the agitator disks 82, beater blades 50 and drying heat applied within cylinder 414.

In at least one embodiment, in addition to the adjustable spacing and configuration of beater blades 50 along shaft 408, the spacing between the ends of paddles 442 and the grinding members 426, as well as the configuration of the beater blades 50 and paddles 442 relative to the grinding members 426 may be adjustable. In one embodiment, the spacing between the ends of paddles 442 and the grinding members 426 may be adjustable and may vary at different locations or within different processing sections 420 along shaft 408. In at least one embodiment, the spacing between the ends of paddles 442 and the grinding members 426 may be larger "or further apart" toward inlet end 410 and may be smaller "closer together" approximate to the discharge end 418. In some embodiments, the size of the material to be processed is gradually refined/reduced as the material passes along the longitudinal dimension for the cylinder 414.

In at least one embodiment, the length of the neck 434 of the beater blades 50 may be adjustable dependent upon the thickness of the grinding members 426. In other embodiments, the length of the neck 434 of the beater blades 50 may be increased as the paddles 442 wear, in order to maintain a desired space between exterior edges of the paddles 442 and the grinding members 426.

In at least one embodiment, grinding members 426 are formed of heavy duty screen elements 468 which may have slotted openings 472. In some embodiments, in addition to the variations in types of openings 472, the arrangement and/or configuration of the openings 472 may vary, and need not be restricted to linear rows and/or columns. In some embodiments, openings 472 may be staggered, or even randomly positioned within heavy duty screen element 468. In other embodiments, grinding member 426 may be formed of hardened flat bar stock; corrugated linear/arcuate plates and may include various geometric surfaces such as saw-tooth and/or round channels/flat top. The materials and geometry identified herein may vary considerably, and the above disclosed examples do not constitute an exhaustive list of alternatives available for use with the grinding members 426.

In at least one embodiment, the clearance between exterior edge of the paddles 442 and the grinding members 426 is adjustable and may be between approximately ½ inch to 1 inch. In at least one embodiment, the grinding members 426 are used to classify/reduce material which has exited from the initial processing section 420 and/or initial drying chamber 422, where the material is very dry and is therefor subject to mechanical degradation. In at least one embodiment, materials prior to processing may have an approximate size of 6 inches or larger. In other embodiments, materials following processing/classification may have an approximate size dimension which may be as small as a 325-mesh or smaller, such as in the processing of magnesium hydroxide. In at least one embodiment, the particles exiting through the product in air outlet 416 may have a temperature of approximately 125 degrees to 210 degrees Fahrenheit.

In at least one embodiment as depicted in FIG. 35, material upon exposure to heat and air within initial processing section 420 and/or drying chamber 422 will lose moisture and become lighter with respect to the air pressure forces within cylinder 414. In at least one embodiment, material which has been dried may pass over a material dam 70,72 and then under a shaft mounted material air dam 68, and then over another material dam 70,72 as depicted by arrow 478 during passage from product inlet 412 to product and air outlet 416 within cylinder 414. In at least one embodiment, any number of material dams 70, 72 may be adjustably placed within cylinder 414. In at least one embodiment, any number of shaft mounted air dams 68 may be adjustably placed along shaft 408 within cylinder 414. In other embodiments, the material dams 70, 72 and shaft mounted air 68 are not required to alternate, and any combination of material dams 70, 72 and shaft mounted air dams 68 may be used within cylinder 414 depending upon properties of the material to be processed within dry/grinder 402.

Figure 31:
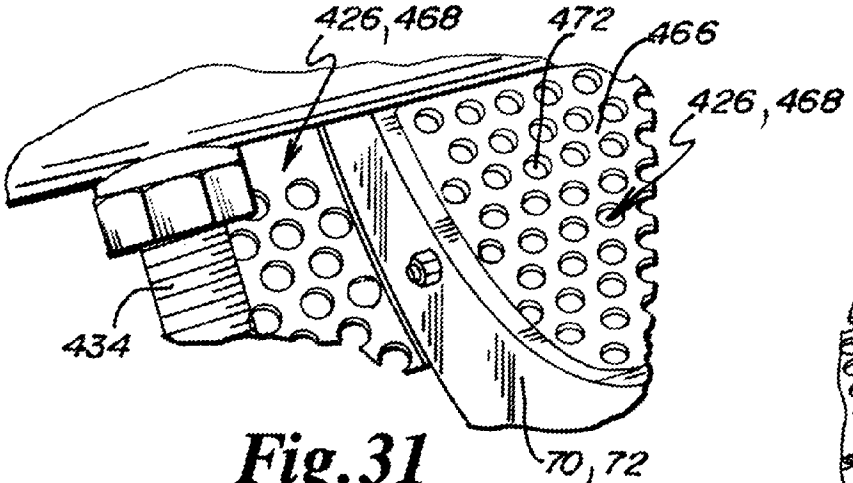
FIG. 31 is a partial cut away detail view of one embodiment of a grinding member and cylindrical mounted material dam.
Figure 33:
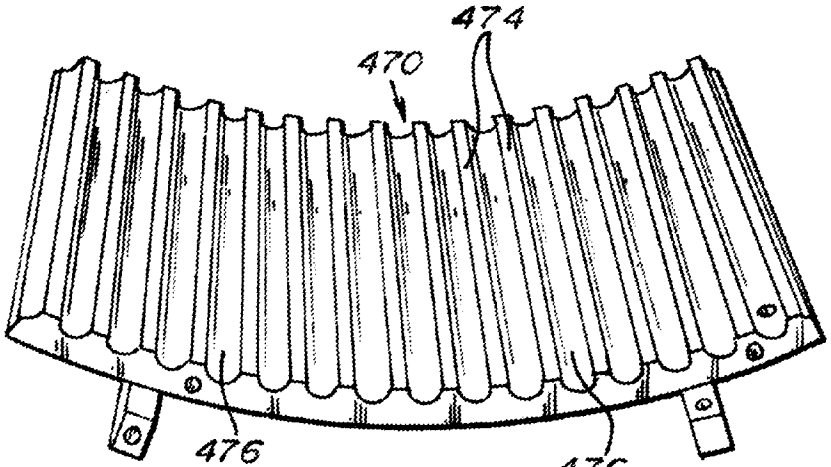
FIG. 33 is a detail view of one embodiment of a grinding plate.
Figure 34B:
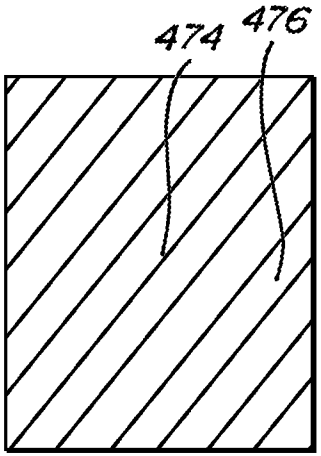
FIG. 34B is a top detail view of an alternative embodiment of a grinding plate.
Figure 34C:
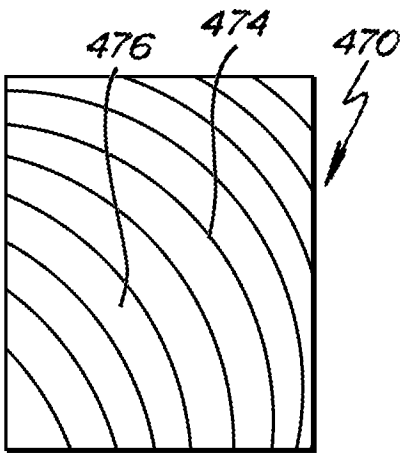
FIG. 34C is a top detail view of an alternative embodiment of a grinding plate.
Figure 34D:
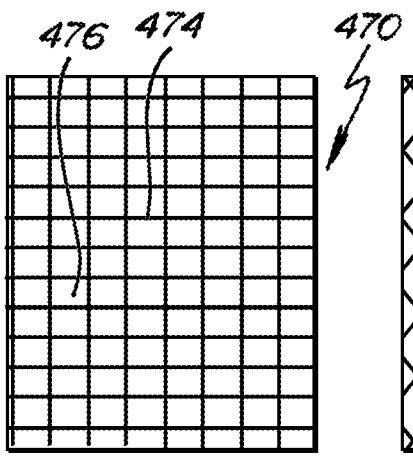
FIG. 34D is a top detail view of an alternative embodiment of a grinding plate.
Figure 34E:
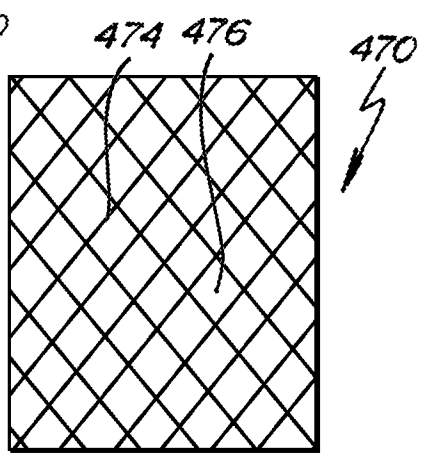
FIG. 34E is a top detail view of an alternative embodiment of a grinding plate.
Figure 34F:
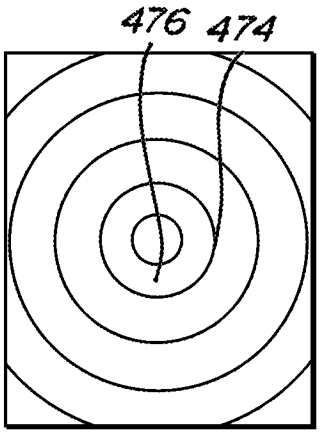
FIG. 34F is a top detail view of an alternative embodiment of a grinding plate.
Figure 34G:
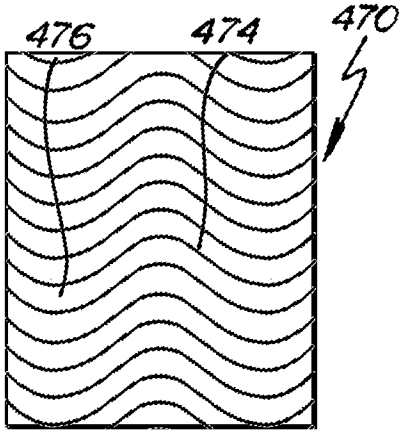
FIG. 34G is a top detail view of an alternative embodiment of a grinding plate.
Figure 34H:
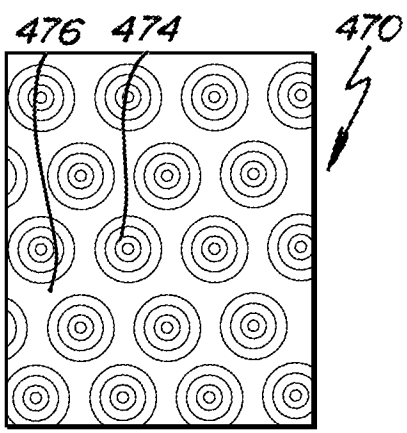
FIG. 34H is a top detail view of an alternative embodiment of a grinding plate.

In at least one embodiment, as depicted in FIG. 31, material dams 70, 72 may formed of one or more sections or may be continuous. In at least one embodiment, bolts and nuts may be utilized to secure portions or sections together to form material dams 70, 72. In at least one embodiment, material dams 70, 72 may be fixedly or adjustably secured to the interior wall of the cylinder 414.

In some embodiments, at least one waste port 480 is provided in the base, lower, or bottom of cylinder 414. In some embodiments, no waste port 480 is provided. In at least one embodiment, the waste port 480 may be substantially rectangular, square, and/or any other shape desired. In other embodiments waste port 480 functions as a collection area for heavier waste materials which have been separated and/or classified from the original starting material. In some embodiments, the waste materials collected in the waste port 480 have been reduced. The provision of a recessed waste port 480 may serve as a natural collection area for waste materials. In some embodiments, a waste port 480 may be provided within each, and/or any desired number of processing sections 420.

In some embodiments, waste slot 482 may traverse material dams 70, 72. Waste slot 482 in one embodiment may be rectangular permitting heavier waste materials such as gravel to pass through the bottom of a material dam 70, 72 into a collection area a recessed area 480.

In at least one embodiment, termination of the rotation of the shaft 408 enables opening of the waste port 480 and the removal of the materials from cylinder 414. In some embodiments, the ends of paddles 442 may include a reenforced sheath which may be used to prolong the useful life of the beater blades 50.

In at least one embodiment, breaker bars may be provided at any desired location within cylinder 414 dependent upon requirements of the material to be processed. In some embodiments, material may be exposed to breaker bars immediately upon entry into cylinder 414 from product inlet 412. An example of material which could be processed within this embodiment is wall board. In other embodiments, the breaker bars may be positioned in processing sections 420 which are downstream from the product inlet 412. In some embodiments, breaker bars may be utilized to assist in the classification/reduction of material which is dry and subject to mechanical degradation. In some embodiments, waste substances may include but are not necessarily limited to, silica in a variety of forms, pyrite, carbonates, iron, and/or other types of ores.

In some embodiments, materials processed by the dryer/grinder 402 may be separated into desired components by air classification techniques (air cyclones) or mechanical classification techniques (screen).

In some embodiments, waste materials may be separated from the cylinder 414 via the waste port 480. In other embodiments, waste material may be separated from the processed materials by air or mechanical classification techniques. In some embodiments, the dryer/grinder 402 may include intermediate discharge locations such as for example "double-dumps" proximate to the bottom or base of cylinder 414 at locations prior to wall mounted material air dam 70, 72 locations.

In some embodiments, operating variables associated with the use of dryer/grinder 402 include, but are not necessarily limited to, the dryer outlet temperature, the shaft 408 rotation speed, the direction of rotation of the shaft 408, the air velocity (CFM) within the cylinder 414, the pitch selected for individual paddles 442, the paddle 442 materials and density, the paddle 442 geometry, the clearance dimension between the paddles 442 and the grinding members 426, the dimensions and/or locations for the wall-mounted material/air dams 70, 72, the dimensions and/or locations for the shaft mounted air dams 68, the design for the material/air dams, the number of material/air dams to be utilized, the use of screens 424, type, dimensions, configuration, and the locations of the grinding members 426 within the cylinder 414, the use, size, location of air dam relief openings or waste slots 482, the removal of portions or sections of the air/material dams 68, 70, 72, the use of discharge screens and/or the use of surface grinding at the discharge screen.

In some embodiments, material may be transported for entry into the product inlet 412 by a pump or screw conveyer.

In other embodiments, other types of material transport may be utilized transfer of material to be processed into the product inlet 412.

In some embodiments, the drying function may be accomplished by the use of direct heat from a gas burner, direct air heat from an oil burner, direct air heat from solid fuel combustor, indirect air heat through the use of a heat exchanger (which may use many forms of fuels), and/or direct air heat from an electric element.

Due to compressive forces acting on particles, agglomerates may be formed within the dryer when material is in a moist state (some materials exhibit this tendency in a rather aggressive manner). Agglomeration may also be a natural consequence of upstream material processing (prior to the drying cycle). In either case, the drying operation is rendered more thermally efficient when agglomerates are broken down to a smaller size, or even the parent particles (which may be the case when the association between particles is weak in the absence of water). In addition to this, it is often of benefit to have material in process down-sized due to mechanical forces, and of particular benefit is the ability to down-size a softer component, while a harder component remains unaltered (or minimally impacted), as this allows for ease of post-drying classification.

In at least one embodiment, the shaft 408 may have a plurality of circumferentially spaced paddles defining at least one rotation path and the cylinder 414 may have as a substantially solid baffle 70, 72 having an orifice 482 disposed there through and configured such that the rotatable paddle assembly may pass an air stream from a zone or section 420 downstream towards discharge end 418.

In at least one embodiment the dryer/grinder 402 may be capable of processing approximately 5,000 pounds to about 30,000 pounds of material per hour.

In at least one embodiment a 300 horsepower motor may be provided to drive the shaft 408 at speeds sufficient to render the dryer/grinder 402 workable for production rates which may approach 30,000 pounds of product per hour.

In at least one embodiment, doors 444 may be used for inspection of cylinder 414 and doors 444 may open in opposite directions.

The rotating action of the paddles 442 in some embodiments may direct the classified material through a gated aperture provided in the cylinder 414.

In at least one embodiment, the faces of the paddles 442, (which are the sides of the paddles which actively push against the air during rotation) may have a fairly narrow width dimension. In some embodiments, the paddles 442 may be between ¼ of an inch to over 2 inches in width. In at least one embodiment, the faces of the paddles 442 may be angled or include a pitch between substantially 10° and 25° degrees relative to the shaft 408.

In at least one embodiment the beater blades 50 may be arranged about the shaft 408 in an opposingly offset manner. The offset arrangement of the beater blades 50 may provide improved air flow and rotational balance as the shaft 408 is rotated. In alternative embodiments beater blades 50 may be arranged in any manner desired by the user.

In at least one embodiment a drive motor may engage drive shaft 408 where drive motor may be any type of drive mechanism known and may engage the drive shaft 408 by gears, belt, chain, hydraulic or other means. The rotating action of the drive shaft 408 rotates the paddles 442 within the cylinder 414 forcing the material in the air stream radially outward, causing the majority of the material to come into content with the interior wall of the cylinder 414.

In at least one embodiment of the dryer/grinder 402 the drive shaft 408 spins the paddles 442 so as to create a radially acting force on the air stream within the cylinder 414. This force causes a significant portion of the classified material to be separated from the air stream. If the classified material is not sticky or viscous, the classified material will be directed through cylinder 414 towards discharge end 418 as a result of the radially acting force.

This completes the description of the preferred and alternate embodiments of the invention. Those skilled in the art may recognize other equivalents to the specific embodiment described herein which equivalents are intended to be encompassed by the claims attached hereto.

What is claimed is:

1. A single pass material processing apparatus comprising:

a. a cylindrical housing having an interior side wall and an inlet end having at least one of an air inlet and a material inlet, said air inlet admitting forced air at an elevated temperature into said cylindrical housing, said cylindrical housing further having a material outlet and defining adjacent processing sections being longitudinally offset from each other along the length of said cylindrical housing;

b. a shaft centrally located in said cylindrical housing said shaft comprising;

c. a plurality of beater blades;

d. at least one retention member separating said adjacent processing sections; and e. at least two grinding members, said at least two grinding members including a first grinding member and a second grinding member, said first grinding member comprising a first contact surface comprising at least one mesh or screen element, and said second grinding member comprising a second contact surface comprising at least one mesh or screen element different from said at least one mesh or screen element of said first contact surface, said first and second grinding members being positioned proximate to said interior side wall, wherein said first grinding member is disposed in one of said adjacent processing sections and said second grinding member is disposed in another of said adjacent processing sections;

wherein the beater blades are each positioned to rotate with the shaft and further wherein rotation of the beater blades is constructed and arranged to strike material in said cylindrical housing and to cause the material to strike the said grinding members, reducing said material in size.

2. The material processing apparatus of claim 1 further comprising at least one of a material dam mounted to said interior side wall and a radially projecting air dam mounted on said shaft, said air dam directing the air radially outward from said shaft and towards said interior side wall and material to be dried, and wherein at least one of said material dam and said air dam forces the air to remain in contact with the material in the cylinder housing wherein a moisture content for said material is decreased.

3. The material processing apparatus of claim 2, said shaft copying at least one agitator disk assembly, wherein said at least one of said agitator disk assemblies is located immediately adjacent the inlet end of the cylindrical housing, said at least one agitator disk assembly comprising:

i) at least one scraper blade support carried by the shaft in an inlet processing section of the material processing apparatus;

ii) at least one end wall scraper blade carried by the at least one scraper blade support and positioned adjacent to an inlet end wall; and iii) at least one side wall scraper blade carried by the at least one scraper blade support and positioned adjacent to said interior side wall; and wherein said radially projecting air dam is mounted on the shaft downstream of the at least one agitator disk assembly and wherein the at least one side wall scraper blade and the at least one end wall scraper blade are each positioned to rotate in a fixed relationship with the shaft to prevent buildup of material on the inside of the cylindrical housing in the inlet processing section, and wherein at least one of the material dam and the air dam forces the air to remain in contact with the material as it leaves the inlet processing section of the material processing apparatus.

4. The material processing apparatus of claim 3 further comprising a plurality of agitator disk assemblies.

5. The material processing apparatus of claim 4, wherein at least one of said plurality of agitator disk assemblies is located outside of the inlet processing section of the material processing apparatus.

6. The material processing apparatus of claim 5, said grinding members comprising at least one of a screen and a grinding plate.

7. The material processing apparatus of claim 6, said material processing apparatus comprising at least one of a plurality of screens and a plurality of grinding plates.

8. The material processing apparatus of claim 7, wherein the at least one of said at least one side wall scraper blade is removably mounted to and spaced about a periphery of each scraper blade support.

9. The material processing apparatus of claim 7, wherein the at least one of said at least one end wall scraper blade is removably mounted to and spaced about a periphery of each scraper blade support.

10. The material processing apparatus of claim 7, wherein at least one of said at least one side wall scraper blade and said at least one end wall scraper blade is adjustably mounted to said scraper blade support.

11. The material processing apparatus of claim 10, wherein at least one of said at least one side wall scraper blade and said at least one end wall scraper blade is adjustably mounted to permit axial movement toward and away from at least one of said interior side wall and said inlet end wall.

12. The material processing apparatus of claim 11, wherein at least one of said plurality of beater blades extend radially from the shaft downstream of at least one of said agitator disk assemblies, each beater blade comprising a relatively flat portion adjustable within a range of pitch angles relative to an axis of the shaft.

13. The material processing apparatus of claim 12, wherein at least one of said plurality of beater blades is adjustably mounted to said shaft to permit axial movement toward and away from at least one of said at least one grinding members.

14. The material processing apparatus of claim 13, further comprising at least one of a plurality of material dams and air dams.

15. The material processing apparatus of claim 14, wherein said material dam is mounted to and extends radially inward from said interior side wall downstream of at least one of said at least one agitator disk assemblies to regulate the retention time of material disposed in at least one of the processing sections.

16. The material processing apparatus of claim 15, wherein said angle of pitch for said relatively flat portions of at least one of said plurality of beater blades is adjustable to an angle relative to the axis of the shaft to direct the material in the housing in an upstream direction such that material is retained temporarily in at least one of said processing sections.

17. The material processing apparatus of claim 16, wherein said angle of pitch for said relatively flat portions of at least one of said plurality of beater blades is adjustable to an angle relative to the axis of the shaft to direct the material in the housing in a downstream direction such that material is advanced to at least one of said processing sections.

18. The material processing apparatus of claim 1, wherein the first and second grinding members have differently shaped contact surfaces and wherein the first and second grinding members are interchangeable with each other.

19. A single pass material processing apparatus comprising:

a. a cylindrical housing having an interior side wall and an inlet end having at least one of an air inlet and a material inlet, said air inlet admitting forced air at an elevated temperature into said cylindrical housing, said cylindrical housing further having a material outlet and defining at least two adjacent processing zones, including a first processing zone and a second processing zone;

b. a shaft centrally located in said cylindrical housing said shaft comprising at least one agitator disk assembly, said at least one agitator disk assembly having at least one scraper blade;

c. a plurality of beater blades on said shaft; and d. at least two grinding members including a first grinding member and a second grinding member, said first grinding member comprising a first contact surface, and said second grinding member comprising a second contact surface, said first contact surface having a different shape than said second contact surface, said first and second grinding members being positioned proximate to said interior side wall, wherein said first grinding member is disposed in said first processing zone and said second grinding member is disposed in said second processing zone;

wherein the at least one scraper blade and the beater blades are each positioned to rotate with the shaft and further wherein rotation of at least one of the at least one scraper blade and the beater blades is constructed and arranged to strike the material and to cause the material to strike the at least two grinding members, reducing said material in size.

20. The material processing apparatus of claim 19, wherein at least one of said at least two grinding members comprising said first contact surface is located within one of said at least two adjacent processing zones and wherein said at least one of said at least two grinding members comprising said second contact surface is located within another of said at least two processing zones.

* * * * *